US008992051B2

(12) United States Patent
Yang et al.

(10) Patent No.: US 8,992,051 B2
(45) **Date of Patent: *Mar. 31, 2015**

(54) SOLID-STATE LAMPS WITH IMPROVED RADIAL EMISSION AND THERMAL PERFORMANCE

(71) Applicant: Intematix Corporation, Fremont, CA (US)

(72) Inventors: Haitao Yang, San Jose, CA (US); Hyung-Chul Lee, Fremont, CA (US); Charles Edwards, Pleasanton, CA (US); Yi-Qun Li, Danville, CA (US)

(73) Assignee: Intematix Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/646,591

(22) Filed: Oct. 5, 2012

(65) Prior Publication Data

US 2013/0176724 A1 Jul. 11, 2013

Related U.S. Application Data

(63) Continuation-in-part of application No. 13/411,497, filed on Mar. 2, 2012, and a continuation-in-part of application No. 29/426,784, filed on Jul. 10, 2012, now Pat. No. Des. 688,820, and a continuation-in-part (Continued)

(51) Int. Cl.
*F21V 29/00* (2006.01)
*F21K 99/00* (2010.01)

(Continued)

(52) U.S. Cl.
CPC ..... *F21V 29/2293* (2013.01); *F21V 29/2231* (2013.01); *F21V 29/262* (2013.01);

(Continued)

(58) Field of Classification Search
None
See application file for complete search history.

(56) References Cited

U.S. PATENT DOCUMENTS 3,290,255 A 12/1966 Smith
3,593,055 A 7/1971 Geusic et al.

(Continued)

FOREIGN PATENT DOCUMENTS

CA 2478001 A1 2/2006
CN 101387388 A 3/2009

(Continued)

OTHER PUBLICATIONS

Final Office Action dated Jun. 9, 2011 for U.S. Appln. No. 12/206,347.

(Continued)

*Primary Examiner* — Ashok Patel
(74) *Attorney, Agent, or Firm* — Vista IP Law Group, LLP

(57) ABSTRACT

A solid-state lamp is described that includes a wavelength conversion component located at one end of the lamp. The solid-state lamp comprises: one or more solid-state light emitting devices (typically LEDs); a thermally conductive body; at least one duct; and a photoluminescence wavelength conversion component remote to the one or more LEDs, located at one end of the lamp. The lamp is configured such that the duct extends through the photoluminescence wavelength conversion component and defines a pathway for thermal airflow through the thermally conductive body to thereby provide cooling of the body and the one or more LEDs.

14 Claims, 34 Drawing Sheets

Related U.S. Application Data of application No. 12/451,470, filed on Apr. 19, 2012, now Pat. No. 8,616,714, which is a continuation of application No. 13/411,497, filed on Mar. 2, 2012.

(60) Provisional application No. 61/544,272, filed on Oct. 6, 2011, provisional application No. 61/568,138, filed on Dec. 7, 2011.

(51) Int. Cl.
*F21V 3/02* (2006.01)
*F21Y 101/02* (2006.01)

(52) U.S. Cl.
CPC ..... *F21K9/1355* (2013.01); *F21K 9/1375* (2013.01); *F21K 9/54* (2013.01); *F21V 3/02* (2013.01); *F21K 9/56* (2013.01); *F21Y 2101/02* (2013.01)
USPC ..... 362/294; 362/373

(56) References Cited

U.S. PATENT DOCUMENTS 3,670,193 A 6/1972 Thorington et al.
3,676,668 A 7/1972 Collins et al.
3,691,482 A 9/1972 Pinnow et al.
3,709,685 A 1/1973 Hercock et al.
3,743,833 A 7/1973 Martie et al.
3,763,405 A 10/1973 Mitsuhata
3,793,046 A 2/1974 Wanmaker et al.
3,819,973 A 6/1974 Hosford
3,819,974 A 6/1974 Stevenson et al.
3,849,707 A 11/1974 Braslau et al.
3,875,456 A 4/1975 Kano et al.
3,932,881 A 1/1976 Mita et al.
3,937,998 A 2/1976 Verstegen et al.
3,972,717 A 8/1976 Wiedemann
4,047,075 A 9/1977 Schober
4,081,764 A 3/1978 Christmann et al.
4,104,076 A 8/1978 Pons
4,143,394 A 3/1979 Schoberl
4,176,294 A 11/1979 Thornton, Jr.
4,176,299 A 11/1979 Thornton
4,211,955 A 7/1980 Ray
4,305,019 A 12/1981 Graff et al.
4,315,192 A 2/1982 Skwirut et al.
4,443,532 A 4/1984 Joy et al.
4,559,470 A 12/1985 Murakami et al.
4,573,766 A 3/1986 Bournay, Jr. et al.
4,618,555 A 10/1986 Suzuki et al.
4,638,214 A 1/1987 Beers et al.
4,667,036 A 5/1987 Iden et al.
4,678,285 A 7/1987 Ohta et al.
4,727,003 A 2/1988 Ohseto et al.
4,772,885 A 9/1988 Uehara et al.
4,845,223 A 7/1989 Seybold et al.
4,859,539 A 8/1989 Tomko et al.
4,915,478 A 4/1990 Lenko et al.
4,918,497 A 4/1990 Edmond
4,946,621 A 8/1990 Fouassier et al.
4,992,704 A 2/1991 Stinson
5,077,161 A 12/1991 Law
5,110,931 A 5/1992 Dietz et al.
5,126,214 A 6/1992 Tokailin et al.
5,131,916 A 7/1992 Eichenauer et al.
5,143,433 A 9/1992 Farrell
5,143,438 A 9/1992 Giddens et al.
5,166,761 A 11/1992 Olson et al.
5,208,462 A 5/1993 O'Connor et al.
5,210,051 A 5/1993 Carter, Jr.
5,211,467 A 5/1993 Seder
5,237,182 A 8/1993 Kitagawa et al.
5,264,034 A 11/1993 Dietz et al.
5,283,425 A 2/1994 Imamura
5,369,289 A 11/1994 Tamaki et al.
5,405,709 A 4/1995 Littman et al.
5,439,971 A 8/1995 Hyche
5,518,808 A 5/1996 Bruno et al.
5,535,230 A 7/1996 Abe
5,557,168 A 9/1996 Nakajima et al.
5,563,621 A 10/1996 Silsby
5,578,839 A 11/1996 Nakamura et al.
5,583,349 A 12/1996 Norman et al.
5,585,640 A 12/1996 Huston et al.
5,619,356 A 4/1997 Kozo et al.
5,660,461 A 8/1997 Ignatius et al.
5,677,417 A 10/1997 Muellen et al.
5,679,152 A 10/1997 Tischler et al.
5,763,901 A 6/1998 Komoto et al.
5,770,887 A 6/1998 Tadatomo et al.
5,771,039 A 6/1998 Ditzik
5,777,350 A 7/1998 Nakamura et al.
5,869,199 A 2/1999 Kido
5,947,592 A 9/1999 Barlow
5,959,316 A 9/1999 Lowery
5,962,971 A 10/1999 Chen
5,998,925 A 12/1999 Shimizu et al.
6,137,217 A 10/2000 Pappalardo et al.
6,183,114 B1 2/2001 Cook et al.
6,220,722 B1 4/2001 Begemann
6,299,332 B1 10/2001 Huang
6,340,824 B1 1/2002 Komoto et al.
6,504,301 B1 1/2003 Lowery
6,576,488 B2 6/2003 Collins et al.
6,600,175 B1 7/2003 Baretz et al.
6,642,618 B2 11/2003 Yagi et al.
6,642,652 B2 11/2003 Collins et al.
6,746,137 B1 6/2004 Yeh
6,746,885 B2 6/2004 Cao
6,793,374 B2 9/2004 Begemann
6,869,812 B1 3/2005 Liu
6,964,501 B2 11/2005 Ryan
6,982,518 B2 1/2006 Chou et al.
7,144,135 B2 12/2006 Martin et al.
7,144,140 B2 12/2006 Sun et al.
7,153,015 B2 12/2006 Brukilacchio
7,311,858 B2 12/2007 Wang et al.
7,314,291 B2 1/2008 Tain et al.
7,390,437 B2 6/2008 Dong et al.
7,434,964 B1 10/2008 Zheng et al.
7,479,662 B2 1/2009 Soules et al.
7,513,653 B1 4/2009 Liu et al.
7,615,795 B2 11/2009 Baretz et al.
7,654,699 B2 2/2010 Chang et al.
7,682,054 B2 3/2010 Hsu et al.
7,712,927 B2 5/2010 Shuai et al.
7,841,752 B2 11/2010 Lee
7,943,945 B2 5/2011 Baretz et al.
8,066,414 B2 11/2011 Pabst et al.
8,143,769 B2 3/2012 Li
8,256,926 B2 9/2012 Louh
8,430,528 B2 4/2013 Yu et al.
8,596,821 B2 * 12/2013 Brandes et al. ..... 362/249.02
8,616,714 B2 12/2013 Lee et al.
2002/0163006 A1 11/2002 Yoganandan et al.
2004/0016938 A1 1/2004 Baretz et al.
2004/0149998 A1 8/2004 Henson et al.
2004/0223315 A1 11/2004 Suehiro et al.
2005/0111234 A1 5/2005 Martin et al.
2005/0174780 A1 8/2005 Park
2005/0276064 A1 12/2005 Wu et al.
2006/0043546 A1 3/2006 Kraus
2006/0049416 A1 3/2006 Baretz et al.
2006/0145123 A1 7/2006 Li et al.
2006/0158090 A1 7/2006 Wang et al.
2006/0261309 A1 11/2006 Li et al.
2007/0029526 A1 2/2007 Cheng et al.
2007/0108459 A1 5/2007 Lu
2007/0159833 A1 7/2007 Netzel et al.
2007/0240346 A1 10/2007 Li et al.
2007/0279862 A1 12/2007 Li
2008/0024067 A1 1/2008 Ishibashi
2008/0111472 A1 5/2008 Liu et al.
2008/0158887 A1 7/2008 Zhu et al.

(56) References Cited

U.S. PATENT DOCUMENTS

| | | | | |
|---|---|---|---|---|
| 2008/0183081 | A1 | 7/2008 | Lys et al. | |
| 2008/0212320 | A1 | 9/2008 | Martynov et al. | |
| 2008/0224597 | A1 | 9/2008 | Baretz et al. | |
| 2008/0224598 | A1 | 9/2008 | Baretz et al. | |
| 2009/0067182 | A1 | 3/2009 | Hsu et al. | |
| 2009/0080205 | A1 | 3/2009 | Chang et al. | |
| 2009/0103296 | A1 | 4/2009 | Harbers | |
| 2009/0195186 | A1 | 8/2009 | Guest et al. | |
| 2009/0237932 | A1 | 9/2009 | Lee | |
| 2009/0294780 | A1 | 12/2009 | Chou et al. | |
| 2010/0060130 | A1 | 3/2010 | Li | |
| 2010/0157571 | A1 | 6/2010 | Lai | |
| 2010/0214781 | A1 | 8/2010 | Chiu et al. | |
| 2010/0259919 | A1 | 10/2010 | Khazi et al. | |
| 2011/0037388 | A1 | 2/2011 | Lou et al. | |
| 2011/0096548 | A1 | 4/2011 | Pickard | |
| 2011/0110096 | A1 | 5/2011 | Hong et al. | |
| 2011/0193463 | A1 | 8/2011 | Daniel | |
| 2011/0215696 | A1 | 9/2011 | Tong et al. | |
| 2011/0215698 | A1* | 9/2011 | Tong et al. | 313/46 |
| 2011/0216523 | A1 | 9/2011 | Tong et al. | |
| 2012/0112615 | A1 | 5/2012 | Kuenzler | |
| 2012/0230034 | A1 | 9/2012 | Boomgaarden et al. | |
| 2012/0300455 | A1 | 11/2012 | Breidenassel et al. | |
| 2013/0229801 | A1* | 9/2013 | Breidenassel et al. | 362/235 |
| 2014/0043789 | A1 | 2/2014 | Horn | |

FOREIGN PATENT DOCUMENTS

| | | | |
|---|---|---|---|
| EP | 647694 | | 4/1995 |
| EP | 1950491 | A1 | 7/2008 |
| GB | 2 017 409 | | 10/1979 |
| JP | S50-79379 | | 11/1973 |
| JP | 60170194 | | 9/1985 |
| JP | 862-189770 | | 8/1987 |
| JP | H01-1794 71 | | 7/1989 |
| JP | 01-260707 | | 10/1989 |
| JP | H02-91980 | | 3/1990 |
| JP | H3-24692 | | 3/1991 |
| JP | 4010665 | | 1/1992 |
| JP | 4010666 | | 1/1992 |
| JP | 04-289691 | | 10/1992 |
| JP | 4-321280 | | 11/1992 |
| JP | 05-152609 | | 6/1993 |
| JP | 6207170 | | 7/1994 |
| JP | 6-267301 | | 9/1994 |
| JP | 6283755 | | 10/1994 |
| JP | 07-099345 | | 4/1995 |
| JP | H07-176794 | | 7/1995 |
| JP | 07-235207 | | 9/1995 |
| JP | H7-282609 | | 10/1995 |
| JP | H08-7614 | | 1/1996 |
| JP | 8-250281 | | 9/1996 |
| JP | 2900928 | | 3/1999 |
| JP | P2003-234513 | | 8/2003 |
| JP | P3724490 | | 9/2005 |
| JP | P3724498 | | 9/2005 |
| JP | 2006047914 | A | 2/2006 |
| JP | 2008098020 | A | 4/2008 |
| JP | 2008204671 | A | 9/2008 |
| JP | 2010225791 | A | 10/2010 |
| KR | 10-1028338 | B1 | 4/2011 |
| KR | 10-2011-0097848 | A | 8/2011 |
| WO | WO 9108508 | | 6/1991 |
| WO | WO 0017569 | A1 | 3/2000 |
| WO | WO 2004051705 | A2 | 6/2004 |
| WO | WO 2006104553 | A1 | 10/2006 |
| WO | WO 2007115322 | A2 | 10/2007 |
| WO | WO 2007130358 | A2 | 11/2007 |
| WO | WO 2007130359 | A2 | 11/2007 |

OTHER PUBLICATIONS

Non-Final Office Action dated Sep. 27, 2010 for U.S. Appl. No. 12/206,347.
International Search Report & Written Opinion dated Mar. 28, 2013 for PCT Appln. No. PCT/US2012/058946.
International Search Report & Written Opinion dated Mar. 28, 2013 for PCT Appln. No. PCT/US12/58877.
International Search Report & Written Opinion dated Mar. 29, 2013 for PCT Appln. No. PCT/US12/58931.
International Preliminary Report on Patentability dated Apr. 17, 2014 for International Patent Appln. No. PCT/US2012/058931.
International Search Report and Written Opinion dated Oct. 30, 2009 for International Appln. No. PCT/US09/55413, 11 pages.
Non-Final Office Action dated Sep. 27, 2010 for U.S. Appln. No. 12/206,347.
International Search Report & Written Opinion dated Nov. 29, 2010 for International PCT Appln. No. PCT/US10/51680, 8 Pages.
International Preliminary Report dated Mar. 17, 2011 for International PCT Appln. No. PCT/US09/55413, 7 Pages.
Final Office Action dated Jun. 9, 2011 for U.S. Appl. No. 12/206,347.
Notice of Allowance dated Dec. 2, 2011 for U.S. Appl. No. 12/206,347.
International Preliminary Report dated Apr. 19, 2012 for International PCT Appln. No. PCT/US10/51680, 6 Pages.
Non-Final OA dated May 7, 2012 for U.S. Appl. No. 13/372,438.
Non-Final Office Action dated Aug. 9, 2012 for U.S. Appl. No. 13/451,470.
Final OA dated Oct. 12, 2012 for U.S. Appl. No. 13/372,438.
First Office Action dated Oct. 25, 2012 for Chinese Appln. No. 200980140235.8.
Non-Final Office Action dated Dec. 5, 2012 for U.S. Appl. No. 12/898,470.
Final Office Action dated Jan. 17, 2013 for U.S. Appl. No. 13/451,470.
Non-Final OA dated Feb. 12, 2013 for U.S. Appl. No. 13/372,438.
Final Office Action dated May 10, 2013 for U.S. Appl. No. 12/898,470.
Notice of Allowance dated Jun. 28, 2013 for U.S. Appl. No. 13/451,470.
Foreign Office Action dated Jul. 12, 2013 for Chinese Appln. No. 200980140235.8.
European Search Report dated Jul. 24, 2013 for European Appln. No. 09812083.5.
Foreign Office Action dated Aug. 5, 2013 for Chinese Appln. No. 201080049831.8.
European Search Report dated Aug. 6, 2013 for European Appln. No. 10822631.7.
Foreign Office Action dated Aug. 20, 2013 for Japanese Appln. No. 2011-526122.
Final Office Action dated Aug. 21, 2013 for U.S. Appl. No. 13/372,438.
Foreign Office Action dated Jan. 24, 2014 for Chinese Appln. No. 200980140235.8.
Non-Final Office Action dated Feb. 11, 2014 for U.S. Appl. No. 12/898,470.
Non-Final Office Action dated Feb. 20, 2014 for U.S. Appl. No. 13/372,438.
"Fraunhofer-Gesellschafl: Research News Special1997", http://www.fhg.de/press/md-e/md1997/sondert2.hlm,(accessed on Jul. 23, 1998), Jan. 1997, Publisher: Fraunhofer Institute.
Adachi, C. et al., "Blue light-emitting organic electroluminescent devices", "Appl. Phys. Lett.", Feb. 26, 1990, pp. 799-801, vol. 56, No. 9.
Akasaki, Isamu, et al., "Photoluminescence of Mg-doped p-type GaN and electroluminescence of GaN p-n junction LED", "Journal of Luminescence", Jan.-Feb. 1991, pp. 666-670, vol. 48-49 pt. 2.
Amano, H., et al., "UV and blue electroluminescence from Al/GaN:Mg/GaN LED treated with low-energy electron beam irradiation (LEEBI)", "Institute of Physics: Conference Series", 1990, pp. 725-730, vol. 106, No. 10.
Apr. 14, 2010 Office Action in U.S. Appl. No. 11/264,124.
Apr. 15, 2009 Office Action in U.S. Appl. No. 11/264,124.
Armaroli, N. et al., "Supramolecular Photochemistry and Photophysics.", "J. Am. Chern. Soc.", 1994, pp. 5211-5217, vol. 116.
Aug. 21, 2006 Office Action in U.S. Appl. No. 10/623,198.
Aug. 24, 2007 Office Action in U.S. Appl. No. 11/264,124.

(56) References Cited

OTHER PUBLICATIONS

Aug. 26, 2010 Office Action in U.S. Appl. No. 12/131,118.
Berggren, M. et al., "Light-emitting diodes with variable colours from polymer blends", "Nature", Dec. 1, 1994, pp. 444-446, vol. 372.
Berggren, M., et al., "White light from an electroluminescent diode made from poly[3(4-octylphenyl)-2,2'-bithiophene] and an oxadiazole . . . ", "Journal of Applied Physics", Dec. 1994, pp. 7530-7534, vol. 76, No. 11.
Boonkosum, W. et al., "Novel Flat Panel display made of amorphous SiN:H/SiC:H thin film LED", "Physical Concepts and Materials for Novel Optoelectronic Device Applications II", 1993, pp. 40-51, vol. 1985.
Bradfield, P.L., et al., "Electroluminescence from sulfur impurities in a p-n junction formed in epitaxial silicon", "Appl. Phys. Lett", 07110/1989, pp. 10D-102D, vol. 55, No. 2.
Chao, Zhang Jin, et al., "White light emitting glasses", "Journal of Solid State Chemistry", 1991, pp. 1729, vol. 93.
Comrie, M. , "Full Color LED Added to Lumex's Lineup", "EBN", Jun. 19, 1995, p. 28.
CRC Handbook, 63rd Ed., (1983) p. E-201.
Das, N.C., et al., "Luminescence spectra of ann-channel metal-oxide-semiconductor field-effect transistor at breakdown", 1990, pp. 1152-1153, vol. 56, No. 12.
Dec. 16, 2004 Office Action in U.S. Appl. No. 10/623,198.
Dictionary Definition of Phosphor, Oxford English Dictionary Online, Mar. 9, 2012 (Only partial available due to corrupt file as provided, on Mar. 22, 2012 in U.S. Appl. No. 12/131,119; Request for Full Reference filed).
El Jouhari, N., et al., "White light generation using fluorescent glasses activated by Ce3+, Tb3+ and Mn2+ ions", "Journal De Physique IV, Colloque C2", Oct. 1992, pp. 257-260, vol. 2.
Feb. 21, 2012 Office Action in U.S. Appl. 12/131,118.
Feb. 26, 2008 Office Action in U.S. Appl. No. 11/264,124.
Feb. 4, 2005 Office Action in U.S. Appl. No. 10/623,198.
Feb. 7, 2007 Office Action in U.S. Appl. No. 11/264,124.
Forrest, S. et al. , "Organic emitters promise a new generation of displays", "Laser Focus World", Feb. 1995, pp. 99-107.
Hamada, Y. et al. , "Blue-Light-Emitting Organic Electroluminescent Devices with Oxadiazole Dimer Dyes as an Emitter", "Jpn. J. Appl. Physics", Jun. 1992, pp. 1812-1816, vol. 31.
Hamakawa, Yoshihiro, et al., "Toward a visible light display by amorphous SiC:H alloy system", "Optoelectronics—Devices and Technologies", Dec. 1989, pp. 281-294, vol. 4, No. 2.
Hirano, Masao, et al., "Various performances of fiber-optical temperature sensor utilizing infrared-to-visible conversion phosphor", "Electrochemisty (JP)", Feb. 1987, pp. 158-164, vol. 55, No. 2, Publisher: Electrochemical Society of Japan.
Jang, S., "Effect of Avalanche-Induced Light Emission on the Multiplication Factor in Bipolar Junction Transistors", "Solid-State Electronics", 1991, pp. 1191-1196, vol. 34, No. 11.
Jan. 29, 2007 Office Action in U.S. Appl. No. 10/623,198.
Jan. 30, 2006 Office Action in U.S. Appl. No. 11/264,124.
Jan. 7, 2011 Office Action in U.S. Appl. No. 12/131,119.
Jul. 10, 2008 Office Action in U.S. Appl. No. 11/264,124.
Jul. 14, 2005 Notice of Allowance, Notice of Allowability, and Examiner's Statement of Reasons for Allowance in U.S. Appl. No. 10/623,198.
Jul. 14, 2011 Office Action in U.S. Appl. No. 12/131,119.
Jul. 7, 2011 Office Action in U.S. Appl. No. 12/131,118.
Jun. 14, 2006 Office Action in U.S. Appl. No. 11/264,124.
Jun. 26, 2007 Office Action in U.S. Appl. No. 10/623,198.
Kido, J. et al. , "1,2,4-Triazole Derivative as an Electron Transport Layer in Organic Luminescent Devices", "Jpn. J. Appl. Phys. ", Jul. 1, 1993, pp. L917-L920, vol. 32.
Kido, J. et al. , "Bright blue electroluminescence from poly(N-vinylcarbazole)", "Appl. Phys. Letters", Nov. 8, 1993, pp. 2627-2629, vol. 63, No. 19.
Kido, J., et al., "White light-emitting organic electroluminescent devices using the poly(N-vinylcarbazole) emitter layer doped with . . . ", "Appl. Phys. Lett.", Feb. 14, 1994, pp. 815-817, vol. 64, No. 7.
Krames, M., et al., "Status and Future of High-Power Light-Emitting Diodes for Solid-Slate Lighting", "Journal of Display Technology", Jun. 2007, pp. 160-175, vol. 3, No. 2.
Kudryashov, V., et al., "Spectra of Superbright Blue and Green InGaN/AlGaN/GaN Light-Emitting diodes", "Journal of the European Ceramic Society", May 1996, pp. 2033-2037, vol. 17.
Larach, S., et al., "Blue emitting luminescent phosphors: Review and status", "Int'l Workshop on Electroluminescence", 1990, pp. 137-143.
LEDs and Laser Diodes, Electus Distribution, copyright 2001, available at URL:http://www.jaycar.com.au/images_uploaded/ledlaser.Pdf.
Lester, S., et al., "High dislocation densities in high efficiency GaN-based light-emitting diodes", "Appl. Phys. Lett.", Mar. 6, 1995, pp. 1249-1251, vol. 66, No. 10.
Lumogen® F Violet 570 Data Sheet; available at the BASF Chemical Company website Lumogen® F Violet 570 Data Sheet; available at the BASF Chemical Company website URL,http://worldaccount.basf.com/wa/EUen_GB/Catalog/Pigments/doc4/BASF/PRD/30048274/.pdt?title=Technical%20Datasheet&asset_type=pds/pdf&language=EN&urn=urn:documentum:eCommerce_soi_EU :09007bb280021e27.pdf:09007bb280021e27.pdf.
Mar. 2, 2009 Office Action in U.S. Appl. No. 10/623,198.
Mar. 22, 2012 Office Action in U.S. Appl. No. 12/131,119.
Mar. 28, 2006 Office Action in U.S. Appl. No. 10/623,198.
Mar. 4, 2011 Notice of Allowance, Notice of Allowability, Examiner's Interview Summary, Examiner's Amendment/Comment and Examiner's Statement of Reason for Allowance in U.S. Appl. No. 11/264,124.
Mar. 7, 2008 Office Action in U.S. Appl. No. 10/623,198.
Maruska, H.P., "Gallium nitride light-emitting diodes (dissertation)", "Dissertation Submitted to Stanford University", Nov. 1973.
Maruska, H.P., et al., "Violet luminescence of Mg-doped GaN", "Appl. Phys. Lett.", Mar. 15, 1973, pp. 303-305, vol. 22, No. 6.
May 4, 2010 Office Action in U.S. Appl. No. 12/131,119.
McGraw-Hill, "McGraw-Hill Dictionary of Scientific and Technical Terms, Third Edition", "McGraw-Hill Dictionary of Scientific and Technical Terms", 1984, p. 912 and 1446, Publisher: McGraw-Hill.
McGraw-Hill, "McGraw-Hill Encyclopedia of Science and Technology, Sixth Edition", "McGraw-Hill Encyclopedia of Science and Technology", 1987, p. 582 and 60-63, vol. 9-10, Publisher: McGraw-Hill.
Mimura, Hidenori, et al., "Visible electroluminescence from uc-SiC/porous Si/c-Si p-n junctions", "Int. J. Optoelectron.", 1994, pp. 211-215, vol. 9, No. 2.
Miura, Noboru, et al., "Several Blue-Emitting Thin-Film Electroluminescent Devices", "Jpn. J. Appl. Phys.", Jan. 15, 1992, pp. L46-L48, vol. 31, No. Part 2, No. 1A IB.
Morkoc et al., "Large-band-gap SIC, 111-V nitride, and II-VI ZnSe-based semiconductor device technologies", J. Appl. Phys. 76(3), 1; Mar. 17, 1994; Illinois University.
Muench, W.V., et al., "Silicon carbide light-emitting diodes with epitaxial junctions", "Solid-State Electronics", Oct. 1976, pp. 871-874, vol. 19, No. 10.
Mukai, T., et al., "Recent progress of nitride-based light emitting devices", "Phys. Stat. Sol.", Sep. 2003, pp. 52-57, vol. 200, No. 1.
Nakamura, S., et al., "High-power InGaN single-quantum-well-structure blue and violet light-emitting diodes", "Appl. Phys. Lett.", Sep. 25, 1995, pp. 1868-1870, vol. 67, No. 13.
Nakamura, S., et al., "The Blue Laser Diode: GaN Based Light Emitters and Lasers", Mar. 21, 1997, p. 239, Publisher: Springer-Verlag.
Nakamura, S., et al., "The Blue Laser Diode: The Complete Story, 2nd Revised and Enlarged Edition", Oct. 2000, pp. 237-240, Publisher: Springer-Verlag.
Nov. 30, 2010 Office Action in U.S. Appl. No. 12/131,118.
Oct. 20, 2008 Office Action in U.S. Appl. No. 10/623,198.

(56) References Cited

OTHER PUBLICATIONS

Pankove, J.I., et al., "Scanning electron microscopy studies of GaN", "Journal of Applied Physics", Apr. 1975, pp. 1647-1652, vol. 46, No. 4.
Pavan, P., et al., "Explanation of Current Crowding Phenomena Induced by Impact Ionization in Advanced Si Bipolar Transistors by Means of . . .", "Microelectronic Engineering", 1992, pp. 699-702, vol. 19.
Pei, Q, et al., "Polymer Light-Emitting Electrochemical Cells", "Science", Aug. 25, 1995, pp. 1086-1088, vol. 269, No. 5227.
Reexam Advisory Action dated Sep. 28, 2012 for U.S. Appl. No. 90/010,940.
Reexam Final Office Action dated May 24, 2012 for U.S. Appl. No. 90/010,940.
Reexam Final Office Action dated Nov. 7, 2011 for U.S. Appl. No. 90/010,940.
Reexam Non-Final Office Action dated Jan. 26, 2012 for U.S. Appl. No. 90/010,940.
Reexam Non-Final Office Action dated Mar. 3, 2011 for U.S. Appl. No. 90/010,940.
Reexam Non-Final Office Action dated Sep. 20, 2010 for U.S. Appl. No. 90/010,940.
Roman. D., "LEDs Turn a Brighter Blue", "Electronic Buyers' News", Jun. 19, 1995, pp. 28 and 35, vol. 960, Publisher: CMP Media LLC.
Saleh and Teich, Fundamentals of Photonics, New York: John Wiley & Sons, 1991, pp. 592-594.
Sato, Yuichi, et al., "Full-color fluorescent display devices using a near-UV light-emitting diode", "Japanese Journal of Applied Physics", Jul. 1996, pp. L838-L839, vol. 35, No. ?A.
Sep. 17, 2009 Notice of Allowance, Notice of Allowability, Examiner's Amendmeni/Comment, and Examiner's Statement of Reasons for Allowance in U.S. Appl. No. 10/623,198.
Sep. 29, 2009 Office Action in U.S. Appl. No. 11/264,124.
Tanaka, Shosaku, et al., "Bright white-light electroluminescence based on nonradiative energy transfer in Ce-and Eu-doped SrS thin films", "Applied Physics Letters", Nov. 23, 1987, pp. 1661-1663, vol. 51, No. 21.
Tanaka, Shosaku, et al., "White Light Emitting Thin-Film Electroluminescent Devices with SrS:Ce,Cl/ZnS:Mn Double Phosphor Layers", "Jpn. J. Appl. Phys.", Mar. 20, 1986, pp. L225-L227, vol. 25, No. 3.
The Penguin Dictionary of Electronics, 3rd edition, pp. 315,437-438, 509-510, copyright 1979, 1988, and 1998.
Ura, M. , "Recent trends of development of silicon monocarbide blue-light emission diodes", "Kinzoku", 1989, pp. 11-15, vol. 59, No. 9.
Werner, K. , "Higher Visibility for LEDs", "IEEE Spectrum", Jul. 1994, pp. 30-39.
Wojciechowski, J. et al. , "Infrared-To-Blue Up-Converting Phosphor", "Electron Technology", 1978, pp. 31-47, vol. 11, No. 3.
Yamaguchi, Y. et al., "High-Brightness SiC Blue LEDs and Their Application to Full Color LED Lamps", "Optoelectronics-Devices and Technologies", Jun. 1992, pp. 57-67, vol. 7, No. 1.
Yang, Y., et al., "Voltage controlled two color light-emitting electrochemical cells", "Appl. Phys. Lett.", 1996, vol. 68, No. 19.
Yoshimi, Masashi, et al., "Amorphous carbon basis blue light electroluminescent device", "Optoelectronics—Devices and Technologies", Jun. 1992, pp. 69-81, vol. 7, No. 1.
Zanoni, E., et al., "Impact ionization, recombination, and visible light emission in ALGaAs/GaAs high electron mobility transistors", "J. Appl. Phys.", 1991, pp. 529-531, vol. 70, No. 1.
Zanoni, E., et al., "Measurements of Avalanche Effects and Light Emission in Advanced Si and SiGe Bipolar Transistors", "Microelectronic Engineering", 1991, pp. 23-26, vol. 15.
Zdanowski, Marek, "Pulse operating up-converting phosphor LED", "Electron Technol. ", 1978, pp. 4961, vol. 11, No. 3.
Zhiming, Chen, et al., "Amorphous thin film white-LED and its light-emitting mechanism", "Conference Record of the 1991 International Display Research Conference", Oct. 1991, pp. 122-125.
Foreign Office Action dated Jul. 14, 2014 for Chinese Appln. No. 200980140235.8.
Non-Final Office Action dated Aug. 5, 2014 for U.S. Appl. No. 13/372,438.
Final Office Action dated Oct. 15, 2014 for U.S. Appl. No. 13/411,497.
Non-Final Office Action dated Jun. 27, 2014 for U.S. Appl. No. 13/411,497.
International Search Report on Patentability dated Apr. 17, 2014 for PCT Appln. No. PCT/US2012/058946.
International Preliminary Report on Patentability dated Apr. 17, 2014 for PCT Appln. No. PCT/US12/58877.

* cited by examiner

SOLID-STATE LAMPS WITH IMPROVED RADIAL EMISSION AND THERMAL PERFORMANCE

CROSS-REFERENCES TO RELATED APPLICATIONS

This application claims priority to the following:

a) benefit of priority to U.S. Provisional Application No. 61/544,272 filed on Oct. 6, 2011;

b) benefit of priority to U.S. Provisional Application No. 61/568,138 filed on Dec. 7, 2011;

c) is a continuation-in-part of U.S. application Ser. No. 13/411,497 filed on Mar. 2, 2012, which claims the benefit of priority to U.S. Provisional Application No. 61/544,272 filed on Oct. 6, 2011 and to U.S. Provisional Application No. 61/568,138 filed on Dec. 7, 2011;

d) is a continuation-in-part of U.S. application Ser. No. 13/451,470 filed on Apr. 19, 2012, which is a continuation of U.S. application Ser. No. 13/411,497 filed on Mar. 2, 2012, which claims the benefit of priority to U.S. Provisional Application No. 61/544,272 filed on Oct. 6, 2011 and to U.S. Provisional Application No. 61/568,138 filed on Dec. 7, 2011;

e) is a continuation-in-part of U.S. Design application No. 29/426,784 filed on Jul. 10, 2012.

All of the above applications are incorporated herein by reference in their entireties.

BACKGROUND OF THE INVENTION

1. Field of the Invention

Embodiments of the invention relate to solid-state lamps with improved emission and thermal performance. In particular, although not exclusively, embodiments concern LED-based (Light Emitting Diode) lamps with an omnidirectional emission pattern.

2. Description of the Related Art

White light emitting LEDs ("white LEDs") are known and are a relatively recent innovation. It was not until LEDs emitting in the blue/ultraviolet part of the electromagnetic spectrum were developed that it became practical to develop white light sources based on LEDs. As taught, for example in U.S. Pat. No. 5,998,925, white LEDs include one or more phosphor materials, that is photo luminescent materials, which absorb a portion of the radiation emitted by the LED and re-emit light of a different color (wavelength). Typically, the LED chip or die generates blue light and the phosphor(s) absorbs a percentage of the blue light and re-emits yellow light or a combination of green and red light, green and yellow light, green and orange or yellow and red light. The portion of the blue light generated by the LED that is not absorbed by the phosphor material combined with the light emitted by the phosphor provides light which appears to the eye as being nearly white in color.

Due to their long operating life expectancy (>50,000 hours) and high luminous efficacy (70 lumens per watt and higher) high brightness white LEDs are increasingly being used to replace conventional fluorescent, compact fluorescent and incandescent light sources.

Typically in white LEDs the phosphor material is mixed with a light transmissive material such as a silicone or epoxy material and the mixture applied to the light emitting surface of the LED die. It is also known to provide the phosphor material as a layer on, or incorporate the phosphor material within, an optical component (a phosphor wavelength conversion component) that is located remotely to the LED die.

Advantages of a remotely located phosphor wavelength conversion component are a reduced likelihood of thermal degradation of the phosphor material and a more consistent color of generated light.

FIG. 1 shows perspective and cross sectional views of a known LED-based lamp (light bulb) 10. The lamp comprises a generally conical shaped thermally conductive body 12 that includes a plurality of latitudinal heat radiating fins (veins) 14 circumferentially spaced around the outer curved surface of the body 10 to aid in the dissipation of heat. The lamp 10 further comprises a connector cap (Edison screw lamp base) 16 enabling the lamp to be directly connected to a power supply using a standard electrical lighting screw socket. The connector cap 16 is mounted to the truncated apex of the body 12. The lamp 10 further comprises one or more blue light emitting LEDs 18 mounted in thermal communication with the base of the body 12. In order to generate white light the lamp 10 further comprises a phosphor wavelength conversion component 20 mounted to the base of the body and configured to enclose the LED(s) 18. As indicated in FIG. 1 the wavelength conversion component 20 can be a generally dome shaped shell and includes one or more phosphor materials to provide wavelength conversion of blue light generated by the LED(s). For aesthetic considerations the lamp can further comprise a light transmissive envelope 22 which encloses the wavelength conversion component.

Traditional incandescent light bulbs are inefficient and have life time issues. LED-based technology is moving to replace traditional bulbs and even CFL with a more efficient and longer life lighting solution. However the known LED-based lamps typically have difficulty matching the functionality and form factor of incandescent bulbs. Embodiments of the invention at least in-part address the limitation of the known LED-based lamps.

SUMMARY OF THE INVENTION

Embodiments of the invention concern solid-state lamps with improved emission and thermal characteristics.

In an embodiment of the invention a lamp, comprises at least one solid-state light emitting device; a thermally conductive body; at least one duct; and a photoluminescence wavelength conversion component remote to the at least one solid state light emitting device, wherein the at least one duct extends through the photoluminescence wavelength conversion component. The duct which can be formed as an integral part of the body or as a separate component is configured to define a pathway for thermal airflow through the thermally conductive body and thereby provide cooling of the body and the at least one light emitting device.

The component in conjunction with the duct and a surface of the body define a volume that encloses the at least one light emitting device. The component can comprise a substantially toroidal shell or a cylindrical shell.

In some embodiments the thermally conductive body further comprises a cavity which in conjunction with the duct define a pathway for thermal airflow through the thermally conductive body. The cavity can comprise a plurality of openings enabling thermal airflow through the duct and the body which can be positioned on a side surface of the body. One or more of the openings can comprise an elongated opening such as a rectangular slot. To aid in dissipating heat the lamp can further comprise circumferentially spaced heat radiating fins on the thermally conductive body. In such an arrangement one or more of the openings can be located between the heat radiating fins.

To maximize light emission from the lamp the lamp can further comprise a light reflective surface disposed between the duct and component. In some embodiments the light reflective surface comprises at least a part of an outer surface of the duct. The light reflective surface can be formed with a light reflective sleeve that is positioned adjacent to the duct. Alternatively the surface of the duct can be treated to make it light reflective. In some embodiments the light reflective surface comprises a substantially conical surface.

To ensure a uniform radial emission pattern the lamp can further comprise a light diffusive component. In some embodiments the light diffusive component comprises a substantially toroidal shell through which the duct passes.

In accordance with an embodiment of the invention a photoluminescence component comprises: a light transmissive wall defining an exterior surface, said component having at least two opening and at least one photoluminescence material which generates light in response to excitation light, wherein in operation the component emits light over angles of at least ±135° with a variation in emitted luminous intensity of less than about 20%. Preferably the component is further configured in operation to emit at least 5% of the total luminous flux over angles of ±135° to ±180°. In some embodiments the component comprises a substantially toroidal shell. For ease of fabrication the toroidal shell preferably comprises two parts that are identical. In other arrangements the component comprises a cylindrical shell.

Typically photoluminescence materials such as phosphors have a yellow to orange appearance and to improve the visual appearance of the component in an off-state the component can further comprise a light diffusive layer on the component. Such light diffusive materials which can include titanium dioxide ($TiO_2$), barium sulfate ($BaSO_4$), magnesium oxide (MgO), silicon dioxide ($SiO_2$) or aluminum oxide ($Al_2O_3$) preferably have a white appearance thereby lessening the yellow appearance of the component in the off-state.

In an embodiment the component comprises: a contiguous exterior wall that defines an interior volume; a first opening defined by the contiguous exterior wall; a second opening defined by the contiguous exterior wall, where the second opening is at an opposite end from the first opening; and wherein the first and second openings are smaller than the maximum length across the contiguous exterior wall.

According to embodiments of the invention a lamp comprises: a thermally conductive body comprising at least one cavity having a first opening positioned on an end surface of the body and a plurality of second openings positioned on another surface of the body; at least one solid-state light emitting device mounted in thermal communication with the end surface of the thermally conductive body; and a duct that extends beyond the at least one solid state light emitting device wherein the duct and cavity define a pathway for thermal airflow through the thermally conductive body. In some embodiments the duct and the body comprise separate components. Alternatively the duct can be formed integrally with the body.

Preferably the duct comprises a light reflective surface. The light reflective surface can be formed with a light reflective sleeve that is positioned adjacent to the duct. Alternatively the light reflective surface can comprise an outer surface of the duct. Typically the light reflective surface comprises a substantially conical surface.

In some embodiments the lamp further comprises a photoluminescence wavelength conversion component configured to absorb at portion of light emitted by the at least one light emitting device and to emit light of a different wavelength. Preferably the wavelength conversion component is remote to the at least one solid-state light emitting device. In preferred embodiments the wavelength conversion component in conjunction with the light reflective surface and the end surface of the body defines a volume enclosing the at least one light emitting device. Preferably the wavelength conversion component comprises a substantially toroidal shell or a cylindrical shell.

The lamp can further comprise a light diffusive component. In some embodiments the light diffusive component in conjunction with the light reflective surface and the end surface of the body defines a volume enclosing the at least one light emitting device. The light diffusive component preferably comprises a toroidal shell. For ease of fabrication and to eliminate the need for a collapsible former during molding of the component, the toroidal shell can comprise two parts that are identical.

According to some embodiments, the lamp comprises a wavelength conversion component that is positioned at an end of the lamp. This configuration produces light emissions that are more directional in nature, generally directed towards the end of the lamp at which the wavelength conversion component is positioned. In some embodiments, the wavelength conversion component has a disc shape with a central opening. The central opening is where a duct/chimney can be mounted.

In some embodiments, the wavelength conversion component is mounted over a mixing chamber base. The mixing chamber base includes both an inner wall and an outer wall. The floor of the mixing chamber base includes a plurality of apertures that align with LEDs on a circuit board. The surface of the inner walls, inner surface of the outer walls, and floor of the mixing chamber base are reflective and define a mixing chamber.

The body of the lamp can be configured as a solid body whose outer surface generally includes a plurality of latitudinal radially extending heat radiating fins that is circumferentially spaced around the outer curved surface of the body. Vertical openings/slots are placed between the cavity and the outer curved surface of the body. The vertical openings are located in proximity to the base of the body, but form an elongated rectangular opening having a width that corresponds to the distance between two heat radiating fins, and are circumferentially spaced between some or all of the heat radiating fins. The perimeter of the top surface of the lamp includes a plurality of openings that extend through passageways to the space between the heat fins, where each opening corresponds to a rectangular shape that extends from the outer edge of the wavelength conversion component.

BRIEF DESCRIPTION OF THE DRAWINGS

In order that the present invention is better understood a LED-based lamp (light bulb) in accordance with embodiments of the invention will now be described, by way of example only, with reference to the accompanying drawings in which.

DETAILED DESCRIPTION OF THE INVENTION

Figure 1:
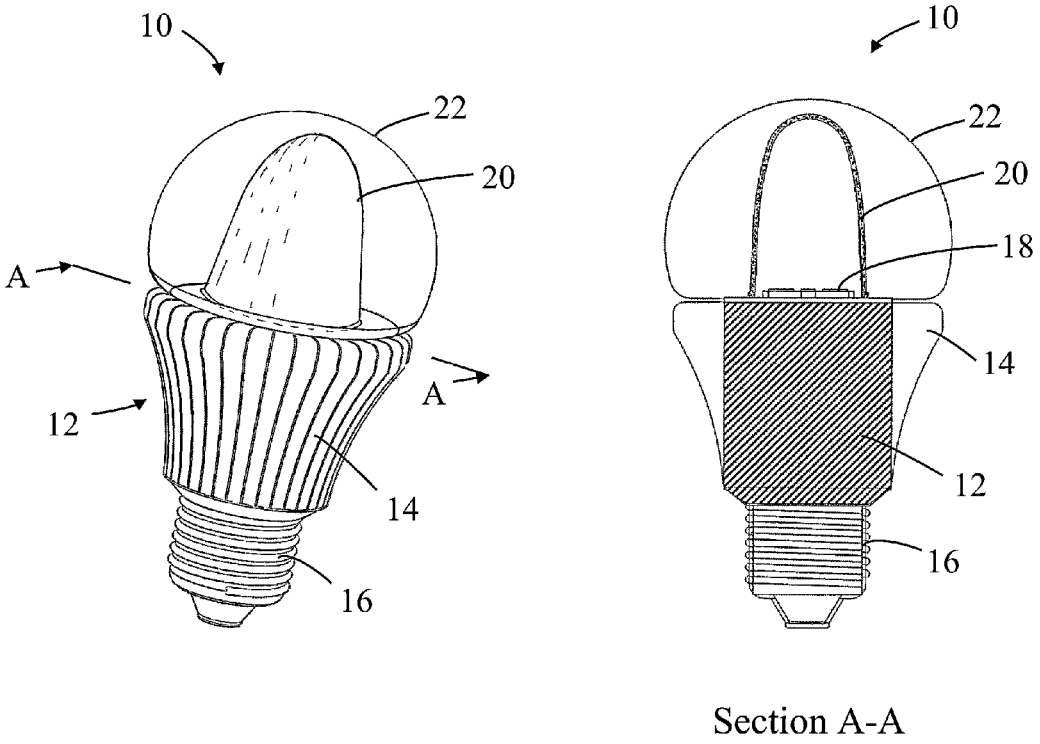
PRIOR ART FIG. 1
FIG. 1 shows perspective and cross sectional views of a known LED-based lamp as previously described.
Figure 2:
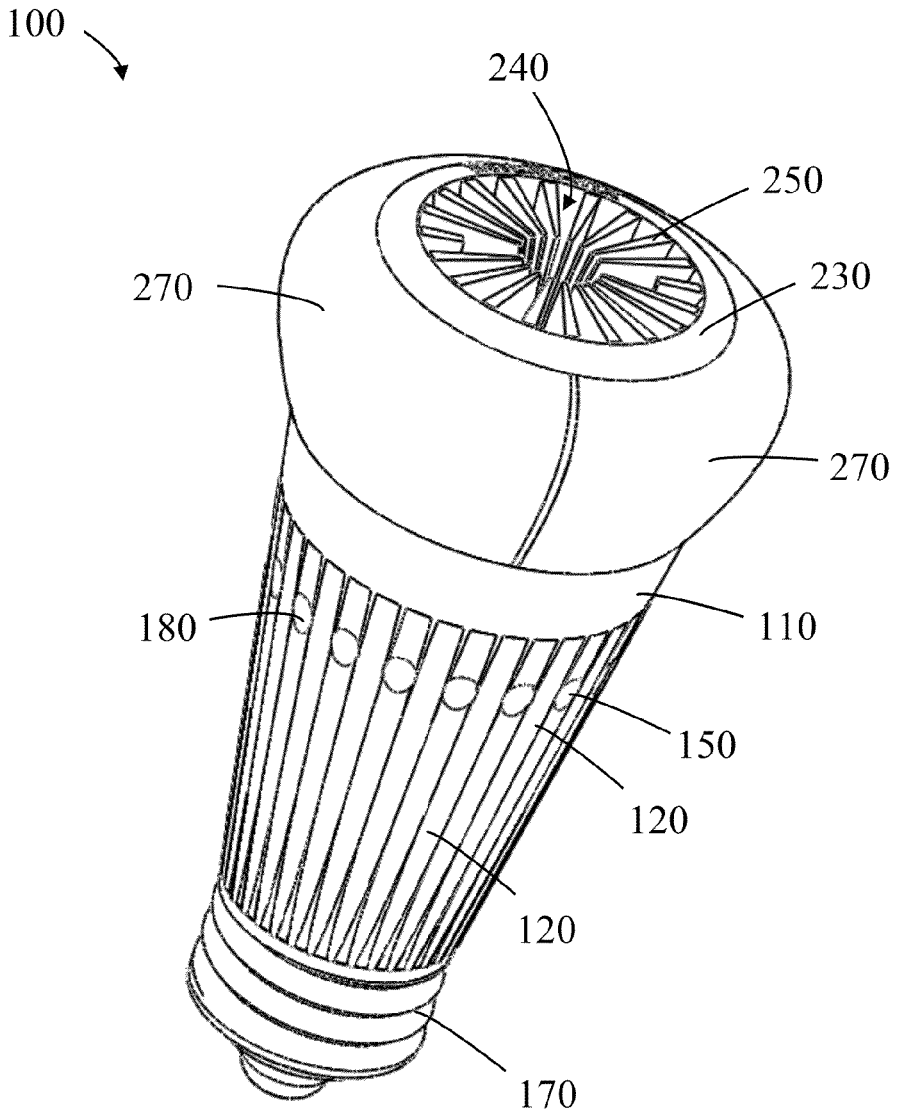
FIG. 2 is a perspective view of an LED-based lamp in accordance with an embodiment of the invention.
Figure 3:
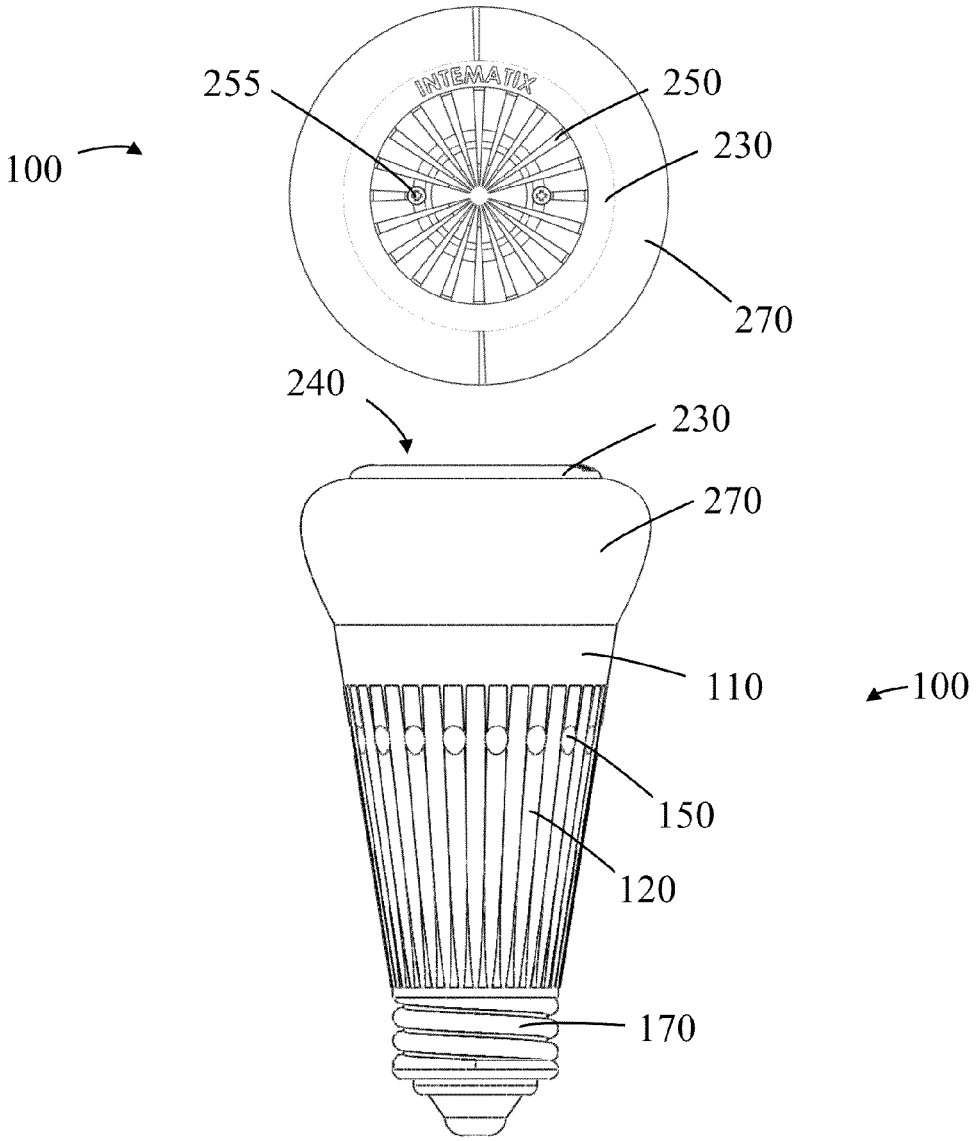
FIG. 3 are plan and side views of the LED-based lamp of FIG. 2.
Figure 4:
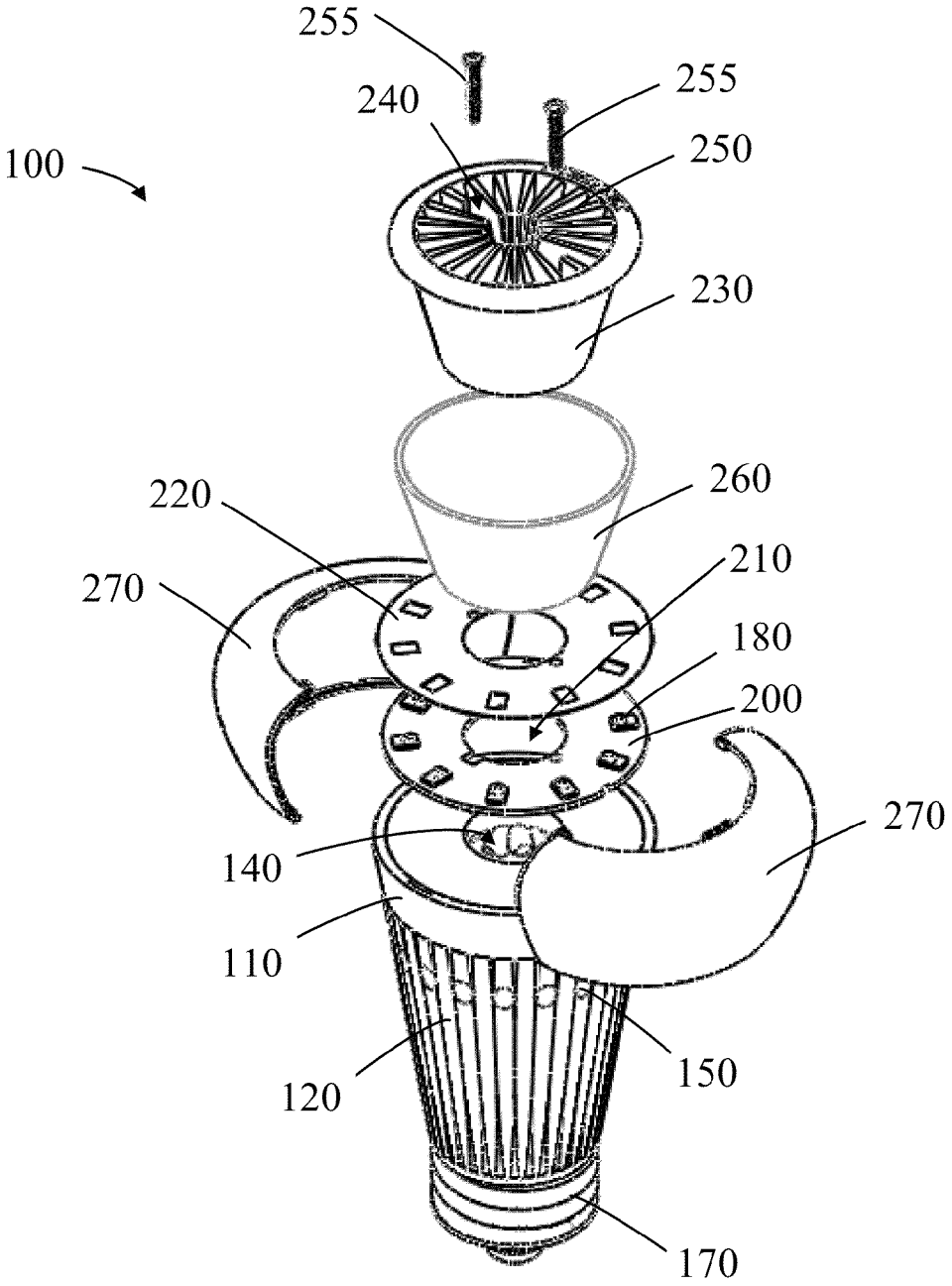
FIG. 4 is a perspective exploded view of the LED-based lamp of FIG. 2.

Throughout this patent specification like reference numerals are used to denote like parts.

Lamps (light bulbs) are available in a number of forms, and are often standardly referenced by a combination of letters and numbers. The letter designation of a lamp typically refers to the particular shape of type of that lamp, such as General Service (A, mushroom), High Wattage General Service (PS—pear shaped), Decorative (B—candle, CA—twisted candle, BA—bent-tip candle, F—flame, P—fancy round, G—globe), Reflector (R), Parabolic aluminized reflector (PAR) and Multifaceted reflector (MR). The number designation refers to the size of a lamp, often by indicating the diameter of a lamp in units of eighths of an inch. Thus, an A-19 type lamp refers to a general service lamp (bulb) whose shape is referred to by the letter "A" and has a maximum diameter two and three eights of an inch. As of the time of filing of this patent document, the most commonly used household "light bulb" is the lamp having the A-19 envelope, which in the United States is commonly sold with an E26 screw base.

Figure 25B:
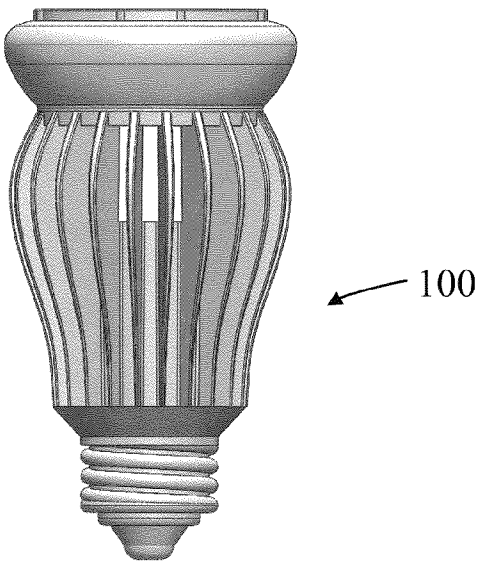
FIGS. 25*a* and 25*b* shows the ANSI form factor and dimensions of an A-19 lamp together with the LED-based lamp of FIGS. 8-10 for comparison.
Figure 25A:
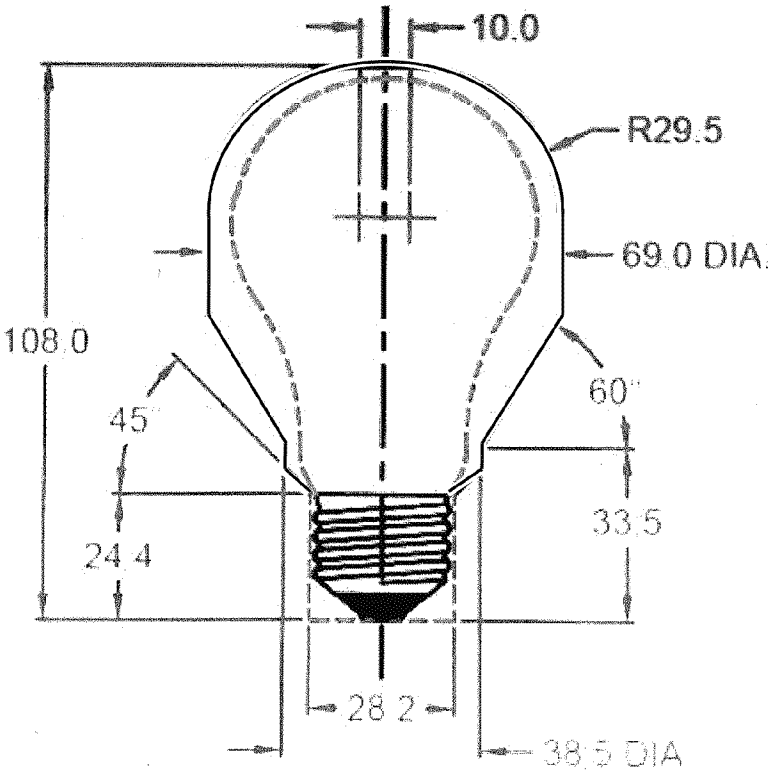

There are various standardization and regulatory bodies that provide exact specifications to define criteria under which a manufacturer is entitled to label a lighting product using these standard reference designations. With regard to the physical dimensions of the lamp, ANSI provides the specifications (ANSI C78.20-2003) that outline the required sizing and shape by which compliance will entitle the manufacture to permissibly label the lamp as an A-19 type lamp, e.g., as illustrated in FIG. 25*a*. Besides the physical dimensions of the lamp, there may also be additional specifications and standards that refer to performance and functionality of the lamp. For example in the United States the US Environmental Protection Agency (EPA) in conjunction with the US Department of Energy (DOE) promulgates performance specifications under which a lamp may be designated as an "ENERGY STAR" compliant product, e.g. identifying the power usage requirements, minimum light output requirements, luminous intensity distribution requirements, luminous efficacy requirements and life expectancy.

The problem is that the disparate requirements of the different specifications and standards create design constraints that are often in tension with one another. For example, the A-19 lamp is associated with very specific physical sizing and dimension requirements, which is needed to make sure A-19 type lamps sold in the marketplace will fit into common household lighting fixtures. However, for an LED-based replacement lamp to be qualified as an A-19 replacement by ENERGY STAR, it must demonstrate certain performance-related criteria that are difficult to achieve with a solid-state lighting product when limited to the form factor and size of the A-19 light lamp.

For example, with respect to the luminous intensity distribution criteria in the ENERGY STAR specifications, for an LED-based replacement lamp to be qualified as an A-19 replacement by ENERGY STAR it must demonstrate an even (+/−20%) luminous emitted intensity over 270° with a minimum of 5% of the total light emission above 270°. The issue is that LED replacement lamps need electronic drive circuitry and an adequate heat sink area; in order to fit these components into an A-19 form factor, the bottom portion of the lamp (envelope) is replaced by a thermally conductive housing that acts as a heat sink and houses the driver circuitry needed to convert AC power to low voltage DC power used by the LEDs. A problem created by the housing of an LED lamp is that it blocks light emission in directions towards the base as is required to be ENERGY STAR compliant. As a result many LED lamps lose the lower light emitting area of traditional bulbs and become directional light sources, emitting most of the light out of the top dome (180° pattern) and virtually no light downward since it is blocked by the heat sink (body), which frustrates the ability of the lamp to comply with the luminous intensity distribution criteria in the ENERGY STAR specification.

Moreover, LED performance is impacted by operating temperature. In general the maximum temperature an LED chip can handle is 150° C. With A-19 lamps being frequently used in ceiling fixtures, hot outdoor environments and enclosed luminaires it is possible for the ambient air temperature surrounding a light lamp to be up to 55° C. Therefore having adequate heat sink area and airflow is critical to reliable LED performance.

As indicated in Table 1, LED lamps targeting replacement of the 100 W incandescent light lamps need to generate 1600 lumens, for 75 W lamp replacements 1100 lumens and for 60 W lamp replacements 800 lumens. This light emission as a function of wattage is non-linear because incandescent lamp performance is non-linear.

TABLE 1

Minimum light output of omnidirectional LED lamps for nominal wattage of lamp to be replaced

| Nominal wattage of lamp to be replaced (Watts) | Minimum initial light output of LED lamp (lumens) |
|---|---|
| 25 | 200 |
| 35 | 325 |
| 40 | 450 |
| 60 | 800 |
| 75 | 1,100 |
| 100 | 1,600 |
| 125 | 2,000 |
| 150 | 2,600 |

Replacement lamps also have dimensional standards. As an example and as shown in FIG. 24*a* an A-19 lamp should have maximum length and diameter standards of 3.5" long and 2⅜" wide. In LED lamps this volume has to be divided into a heat sink portion and a light emitting portion. Generally the heat sink portion is at the base of the LED lamp and usually requires 50% or even more of the lamp length for 60 W and higher wattage equivalent replacement lamps. Even using this portion as a heat sink it has been very difficult to get adequate heat sink cooling for LED lamps having these size limitations. Larger LED heat sinks can make the replacement lamp no longer fit into many standard fixtures. The LED heat sinks also frequently blocks light in one direction adding to the light emission pattern problem. Some LED lamps have attempted to use active cooling (fans) but this adds cost, reliability issues and noise and is not considered a preferred approach.

Additionally white LEDs are point light sources. If packaged in an array without a diffuser dome or other optical cover they appear as an array of very bright spots, often called "glare". Such glare is undesirable in a lamp replacement with a larger smooth light emitting area similar to traditional incandescent bulbs being preferred.

Currently LED replacement lamps are considered too expensive for the general consumer market. Typically an A-19, 60 W replacement LED lamp costs many times the cost of an incandescent bulb or compact fluorescent lamp. The high cost is due to the complex and expensive construction and components used in these lamps.

Embodiments of the present invention address, at least in part, each of the above issues. In some embodiments of the invention the LEDs are provided on a single component, typically a circuit board, whilst maintaining a broad emission pattern. Embodiments of the invention allow a lamp to be fabricated using simple injection molded plastics parts for the both optics and the heat sink components. Furthermore the design minimizes component count in the optics, heat sink and electronics thereby minimizing costs. Increased optical efficiency as well as thermal behavior combine to enable a reduction in the LED component count, heat sink area and size of power supply. All of this results in a lamp of lower cost and higher efficiency. Moreover embodiments of the invention enable the realization of ENERGY STAR compliant lamps for 75 Watts and higher replacement lamps.

An LED-based lamp 100 in accordance with embodiments of the invention is now described with reference to FIGS. 2 to 5 which respectively show a perspective view; plan and side views; a perspective exploded view and a cross sectional view of the lamp. The lamp 100 is configured for operation with a 110V (r.m.s.) AC (60 Hz) mains power supply as is found in North America and is intended for use as an ENERGY STAR compliant replacement for a 75 W A-19 incandescent light bulb with a minimum initial light output of 1,100 lumens.

The lamp 100 comprises a generally conical shaped thermally conductive body 110. The body 110 is a solid body whose outer surface generally resembles a frustrum of a cone; that is, a cone whose apex or vertex is truncated by a plane that is parallel to the base (substantially frustoconical). The body 110 is made of a material with a high thermal conductivity (typically ≥150 $Wm^{-1}K^{-1}$, preferably ≥200 $Wm^{-1}K^{-1}$) such as for example aluminum (≈250 $Wm^{-1}K^{-1}$), an alloy of aluminum, a magnesium alloy, a metal loaded plastics material such as a polymer, for example an epoxy. Conveniently the body 110 can be die cast when it comprises a metal alloy or molded, by for example injection molding, when it comprises a metal loaded polymer.

A plurality of latitudinal radially extending heat radiating fins (veins) 120 is circumferentially spaced around the outer curved surface of the body 110. Since the lighting device is intended to replace a conventional incandescent A-19 light bulb the dimensions of the lamp are selected to ensure that the device will fit a conventional lighting fixture.

Figure 5:
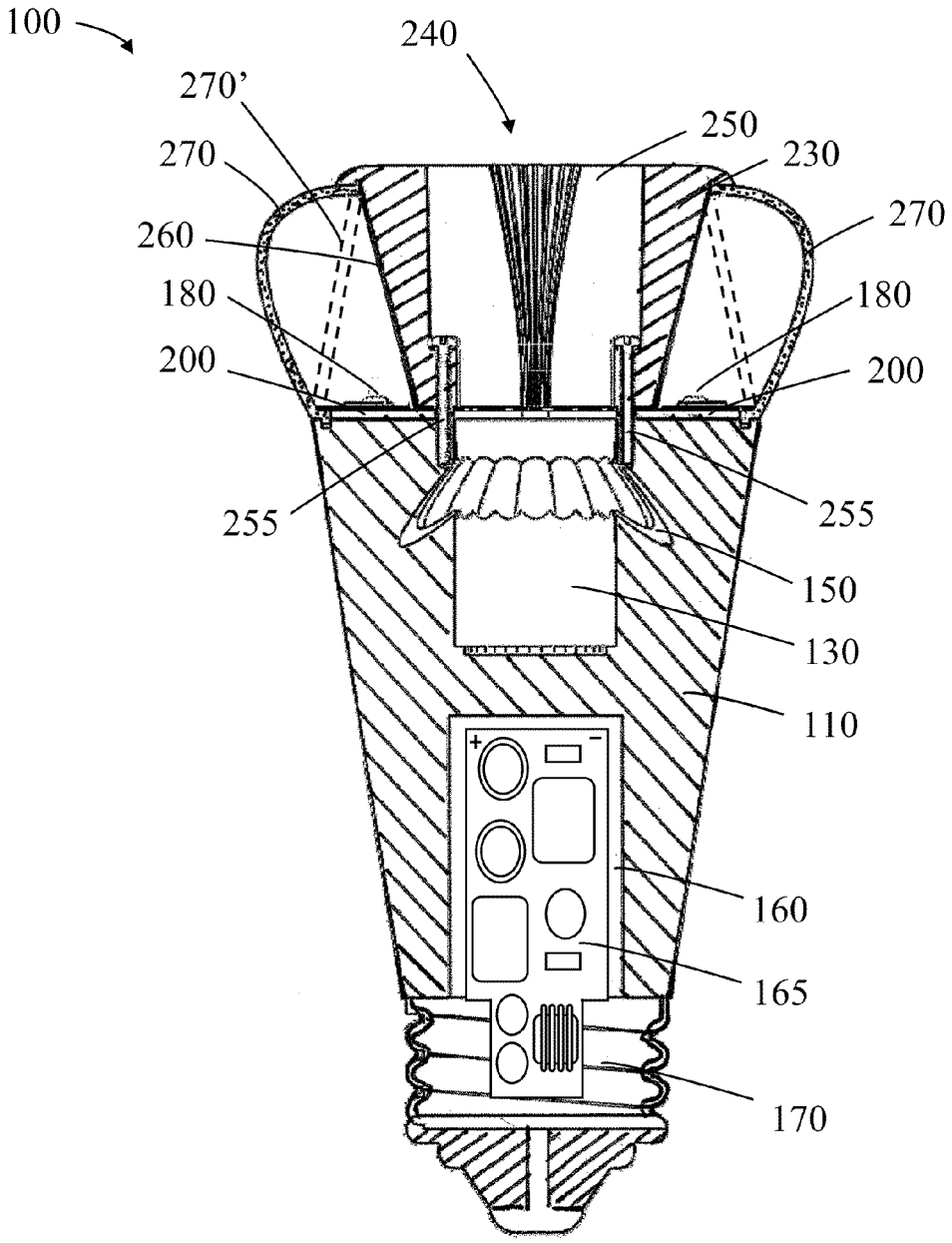
FIG. 5 is a cross sectional view of the LED-based lamp of FIG. 2.

A coaxial cylindrical cavity 130 extends into the body 110 from a circular opening 140 in the base of the body. Located between each fin 120 there is provided a generally circular passage (conduits) 150 that connects the cavity 130 to the outer curved surface of the body. In the exemplary embodiment the passages 150 are located in proximity to the base of the body. The passages 150 are circumferentially spaced and each passage extends in a generally radial direction in a direction away from the base of the body, that is, as shown in FIG. 5 in a generally downwardly extending direction. As will be further described the passages 150 in conjunction with the cavity 130 enable a flow of air through the body to increase cooling of the lamp. An example of lamps embodying a cavity to facilitate thermal air flow and cooling of a solid-state lamp are disclosed in co-pending U.S. patent application Ser. No. 12/206,347 filed Sep. 8, 2008 entitled "Light Emitting Diode (LED) Lighting Devices" the entire content of which is hereby incorporated by way of reference thereto.

The body can further comprise a coaxial cylindrical cavity 160 that extends into the body 110 from the truncated apex the body 110. Rectifier or other driver circuitry 165 (see FIG. 5) for operating the lamp can be housed in the cavity 160.

The lamp 100 further comprises an E26 connector cap (Edison screw lamp base) 170 enabling the lamp to be directly connected to a mains power supply using a standard electrical lighting screw socket. It will be appreciated that depending on the intended application other connector caps can be used such as, for example, a double contact bayonet connector (i.e. B22d or BC) as is commonly used in the United Kingdom, Ireland, Australia, New Zealand and various parts of the British Commonwealth or an E27 screw base (Edison screw lamp base) as used in Europe. The connector cap 170 is mounted to the truncated apex of the body 110 and the body electrically isolated from the cap.

Figure 18:
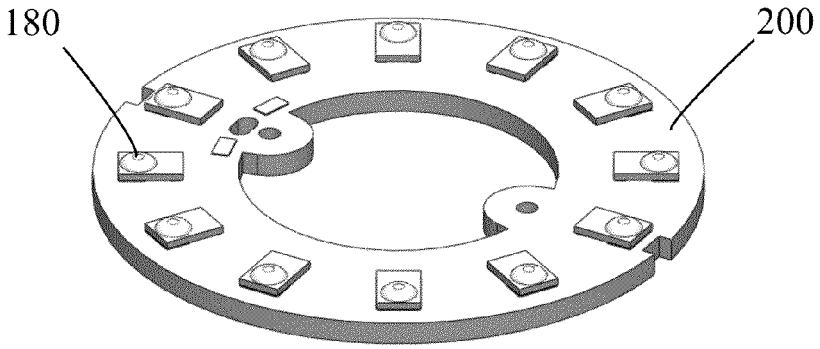
FIG. 18 illustrates a substrate for LEDs.

A plurality (twelve in the example illustrated) of solid-state light emitter 180 are mounted as an annular array on a substrate 200, as shown in more detail in FIG. 18. In some embodiments, the substrate 200 comprises an annular shaped MCPCB (metal core printed circuit board). As is known a MCPCB comprises a layered structure composed of a metal core base, typically aluminum, a thermally conducting/electrically insulating dielectric layer and a copper circuit layer for electrically connecting electrical components in a desired circuit configuration. The metal core base of the MCPCB 200 is mounted in thermal communication with the base of the body 110 with the aid of a thermally conducting compound such as for example an adhesive containing a standard heat sink compound containing beryllium oxide or aluminum nitride. The circuit board 200 is dimensioned to be substantially the same as the base of the body 110 and includes a central hole 210 corresponding to the circular opening 140.

Figure 17:
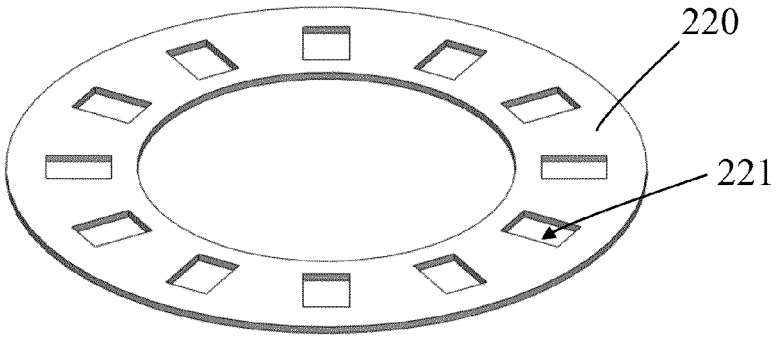
FIG. 17 illustrates a reflective mask for the substrate of FIG. 18.

Each solid-state light emitter 180 can comprise a 1 W gallium nitride-based blue light emitting LED. The LEDs 180 are configured such that their principle emission axis is parallel with the axis of the lamp. In other embodiments the LEDs can be configured such that their principle emission axis is in a radial direction. A light reflective mask 220 overlays the MCPCB and includes apertures 221 corresponding to each LED and to the opening 210 (as shown in FIG. 17).

Figure 13:
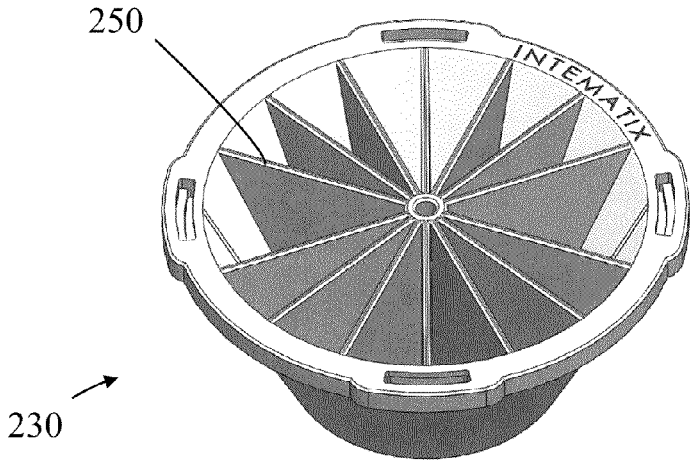
FIGS. 13-15 illustrate an embodiment of an duct.
Figure 14:
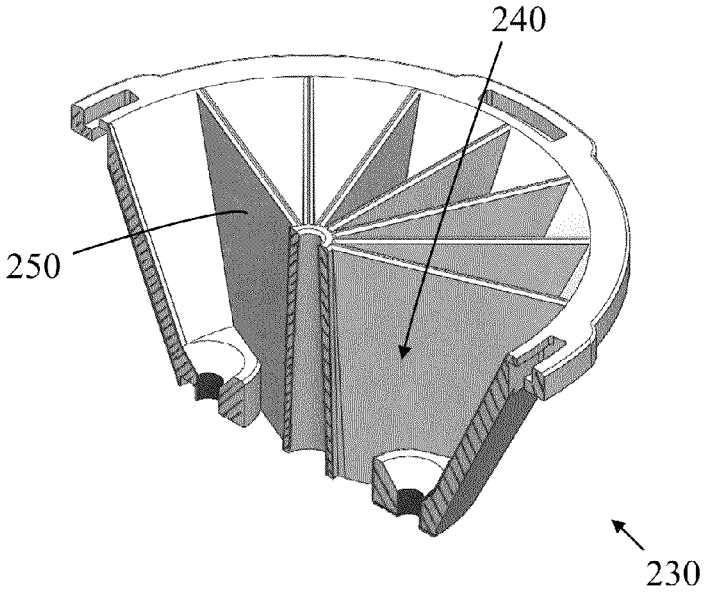
Figure 15:
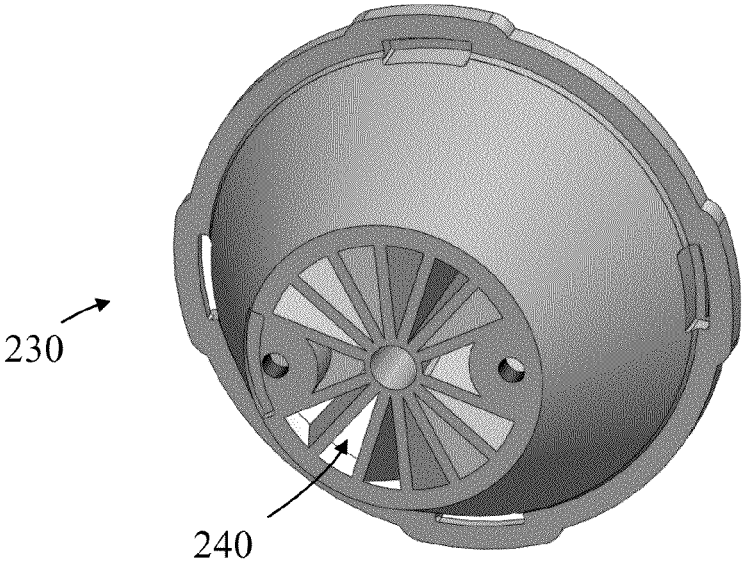
Figure 16:
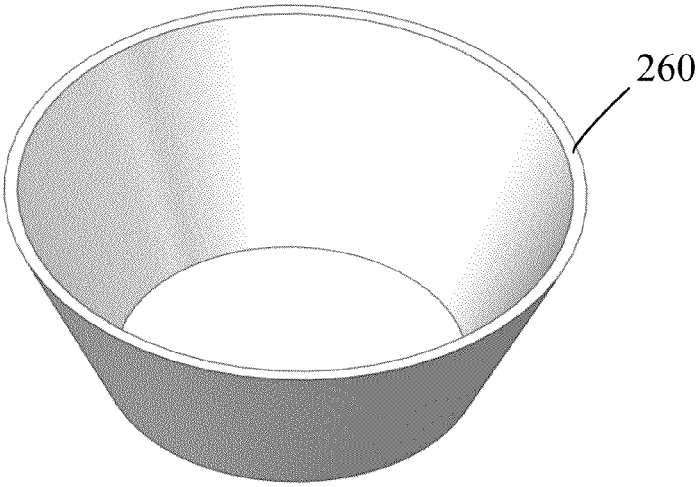
FIG. 16 illustrates a light reflective covering for the duct of FIGS. 13-15.

The lamp 100 further comprises a duct (conduit) 230 that protrudes from the plane of circuit board 200. In the current embodiment, the duct 230 is a thermally conductive generally frustoconical hollow component that includes an axial through passage with a circular opening 240 at its base. As will be described the duct 230 can act as both a heat sink to aid in the dissipation of heat generated by the LEDs 180 and as a light reflector to ensure the lamp has an omnidirectional emission. In this specification "duct" can be termed an "extended flue" or "extended duct" and it will be appreciated that such references can be used interchangeably. As shown in more detail in FIG. 13 and FIG. 14, the passage can include a plurality of heat radiating fins 250 that extend into through the passage towards the axis in a radial direction. The duct 230 can be made of a material with a high thermal conductivity such as for example aluminum, an alloy of aluminum, a magnesium alloy, a metal loaded plastics material such as a polymer, for example an epoxy. Conveniently the duct 230 can be die cast when it comprises a metal alloy or molded when it comprises a metal loaded polymer. The duct 230 is mounted with the truncated apex of the duct 230 in thermal communication with the base of the body 110. As indicated the duct 230 can be attached to the base using screw fasteners 255. The size of the axial through passage is configured to correspond to the diameter of the cavity 130 such that when the duct 230 is mounted to the body (see FIG. 5) the duct 230 provides an extension of the cavity away from the base of the body. It will be appreciated that the duct 230 is configured to provide fluid communication between the opening 240 and the cavity. The lamp can further comprise a light reflective conical sleeve 260 that is mounted on the outer curved conical surface of the duct 230. The light reflective conical sleeve 260 may be implemented using any suitable material. In some embodiments, the light reflective conical sleeve 260 comprises a reflective sheet material that is affixed to the exterior surface of the duct 230. In some embodiments, instead of utilizing a light reflective conical sleeve 260, the outer surface of the duct 230 can be treated to make it light reflective such as for example a powder coating or metallization.

The lamp 100 further comprises a light transmissive wavelength conversion component 270 that includes one or more photoluminescence materials. The photoluminescence materials material may be integrally formed into the wavelength conversion component 270 or is deposited onto a surface of the wavelength conversion component 270. In some embodiments, the photoluminescence materials comprise phosphor. For the purposes of illustration only, the following description is made with reference to photoluminescence materials embodied specifically as phosphor materials. However, the invention is applicable to any type of photoluminescence material, such as either phosphor materials or quantum dots. A quantum dot is a portion of matter (e.g. semiconductor) whose excitons are confined in all three spatial dimensions that may be excited by radiation energy to emit light of a particular wavelength or range of wavelengths. As such, the invention is not limited to phosphor based wavelength conversion components unless claimed as such. The phosphor material can comprise an inorganic or organic phosphor such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in U.S. Pat. No. 7,575,697 B2 "Silicate-based green phosphors" (assigned to Internatix Corp.), U.S. Pat. No. 7,601,276 B2 "Two phase silicate-based yellow phosphors" (assigned to Internatix Corp.), U.S. Pat. No. 7,655,156 B2 "Silicate-based orange phosphors" (assigned to Internatix Corp.) and U.S. Pat. No. 7,311,858 B2 "Silicate-based yellow-green phosphors" (assigned to Internatix Corp.). The phosphor can also comprise an aluminate-based material such as is taught in co-pending patent application US2006/0158090 A1 "Novel aluminate-based green phosphors" and patent U.S. Pat. No. 7,390,437 B2 "Aluminate-based blue phosphors" (assigned to Internatix Corp.), an aluminum-silicate phosphor as taught in co-pending application US2008/0111472 A1 "Aluminum-silicate orange-red phosphor" or a nitride-based red phosphor material such as is taught in co-pending United States patent applications US2009/0283721 A1 "Nitride-based red phosphors" and US2010/074963 A1 "Nitride-based red-emitting in RGB (red-green-blue) lighting systems". It will be appreciated that the phosphor material is not limited to the examples described and can comprise any phosphor material including nitride and/or sulfate phosphor materials, oxy-nitrides and oxy-sulfate phosphors or garnet materials (YAG).

Figure 19:
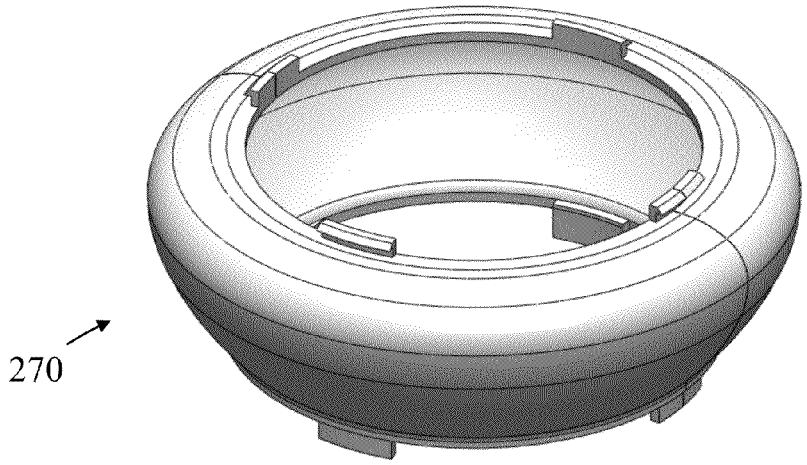
FIGS. 19-20 illustrate an exterior wavelength conversion or diffusing component.
Figure 20:
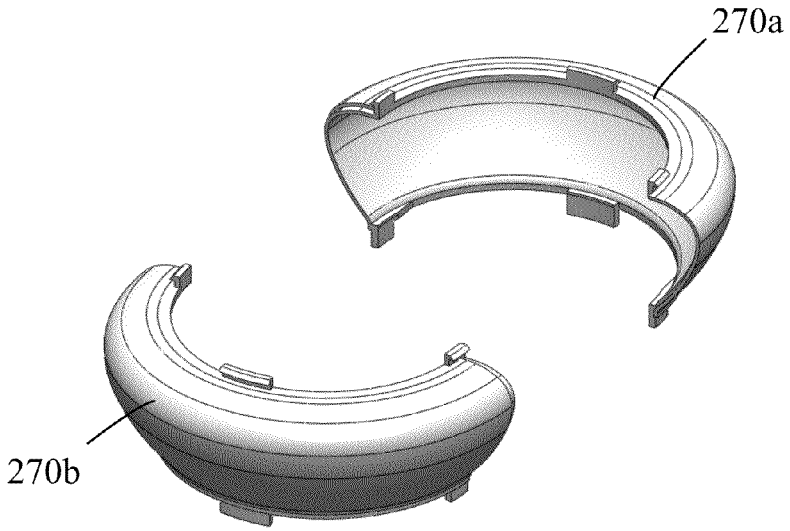

As shown in more detail in FIG. 19 and FIG. 20, the wavelength conversion component 270 can comprise a generally toroidal shell that is composed of two parts 270*a* and 270*b*. As can be best seen from FIGS. 19 and 20 the shape of the wavelength conversion component comprises a surface of revolution that is generated by revolving an arc shaped figure (profile) about an axis that is external to the figure which is parallel to the plane of the figure and does not intersect the figure. It will be appreciated that the profile of the shell need not be a closed figure and in the embodiment in FIGS. 19 and 20 the profile comprises a part of a spiral. Examples of profiles for the toroidal shell include but are not limited to a part of an Archimedian spiral, a part of a hyperbolic spiral or a part of a logarithmic spiral. In other embodiments the profile can comprise a part of a circle, a part of an ellipse or a part of a parabola.

Therefore in the context of this application toroidal refers to a surface of revolution generated by revolving a plane geometrical figure about an axis that is external to figure and is not limited to closed figures such as a torus in which the figure is circular.

The wavelength conversion component 270 can be fabricated by injection molding and be fabricated from polycarbonate or acrylic. A benefit of fabricating this component is two parts is that this eliminates the need to use a collapsible form during the molding process. In the present embodiment, the two parts 270*a* and 270*b* are identical, which permits even more manufacturing efficiencies, since the wavelength conversion component 270 to be easily manufactured without the complexities of having two different types of parts, i.e. a single part type can be made and used assemble a single part during manufacture. In alternative embodiments the wavelength conversion component can comprise a single component. In some embodiments the photo-luminescent material can be homogeniously distributed throughout the volume of the component 270 as part of the molding process. Alternatively the photo-luminescent material can be provided as a layer on the inner or outer surfaces of the component.

In other embodiments, the wavelength conversion component can comprise an interior component 270' that is interior to the exterior component 270, as indicated by dashed lines 270' in FIG. 5. In such arrangements the toroidal component 270 can comprise a light diffusive material. The light diffusive material may be used for aesthetic considerations and to improve the visual appearance of the lamp in an "off-state". One common issue with phosphor-based lighting devices is the non-white color appearance of the device in its OFF state. During the ON state of the LED device, the LED chip or die generates blue light and the phosphor(s) absorbs a percentage of the blue light and re-emits yellow light or a combination of green and red light, green and yellow light, green and orange, or yellow and red light. The portion of the blue light generated by the LED that is not absorbed by the phosphor combined with the light emitted by the phosphor provides light which appears to the human eye as being nearly white in color. However, for a phosphor device in its OFF state, the absence of the blue light that would otherwise be produced by the LED in the ON state causes the device to have a yellowish, yellow-orange, or orange-color appearance. A potential consumer or purchaser of such lamps that is seeking a white-appearing light may be quite confused by the yellowish, yellow-orange, or orange-color appearance of such devices in the marketplace, since the device on a store shelf is in its OFF state. This may be off-putting or undesirable to the potential purchasers and hence cause loss of sales to target customers. In the current embodiment, if the interior component 270' is covered by the exterior component 270, then proper selection of the material of the exterior component 270 can improve the off state appearance of the lamp, e.g. by configuring the exterior component 270 to include a light diffusive material such as a mixture of a light transmissive binder and particles of a light diffusive material such as titanium dioxide ($TiO_2$). The light diffusive material can also other materials such as barium sulfate ($BaSO_4$), magnesium oxide (MgO), silicon dioxide ($SiO_2$) or aluminum oxide ($Al_2O_3$). Typically the light diffusive material is white in color. In this way, in an off-state, the phosphor material within the lamp will appear white in color instead of the phosphor material color which is typically yellow-green, yellow or orange in color.

Figure 21:
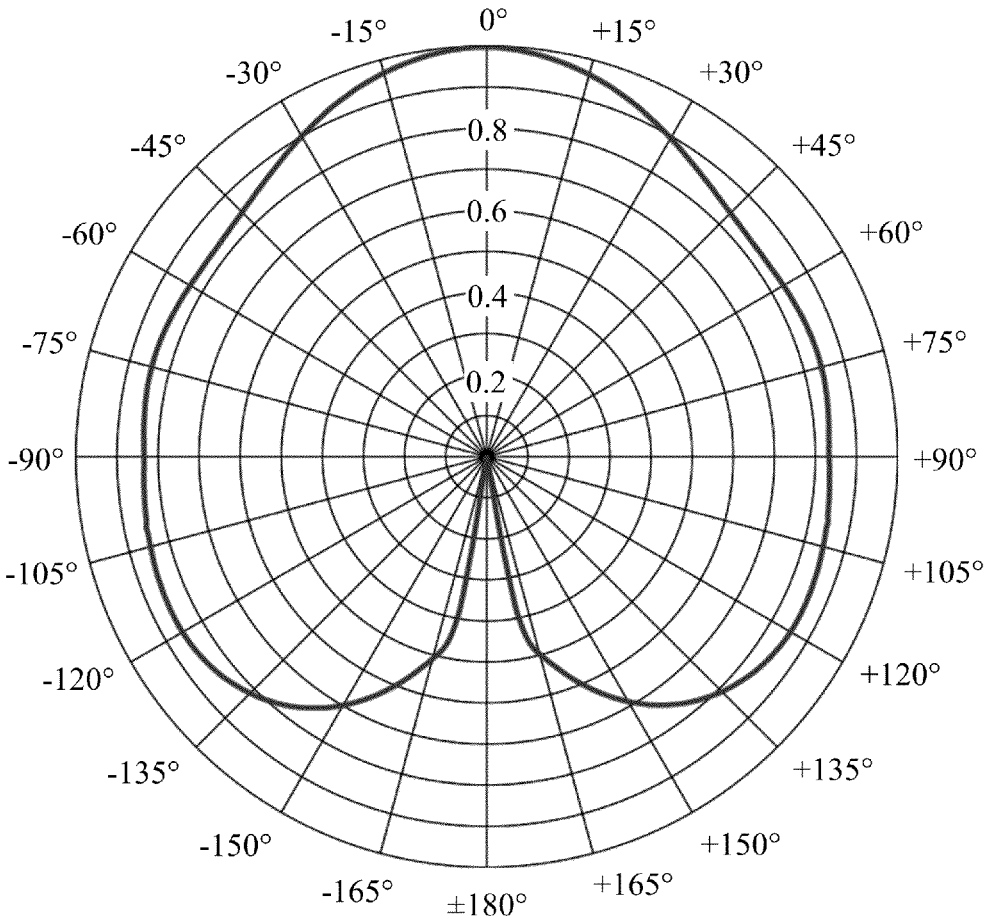
FIG. 21 is a polar diagram of measured luminous intensity (luminous flux per unit solid angle) angular distribution for the lamp of FIGS. 8 to 10.

A benefit of a shaped wavelength conversion component can be ease of molding. The interior wavelength conversion component 270' can be arranged in any suitable shape. For example, as shown in FIG. 5, the interior wavelength conversion component 270' has a frustonical shape. Alternatively, as shown in FIG. 21, the interior wavelength conversion component 270' has a cylindrical shape.

In operation the LEDs 180 generate blue excitation light a portion of which excite the phosphor within the wavelength conversion component 270 which in response generates by a process of photoluminescence light of another wavelength (color) typically yellow, yellow/green, orange, red or a combination thereof. The portion of blue LED generated light combined with the phosphor generated light gives the lamp an emission product 400 (FIG. 6) that is white in color.

It will be appreciated that the present arrangement can also be employed using non-remote-phosphor lamps that employ white LEDs as the solid-state light emitters 180. Such white LEDs can be formed using powdered phosphor material that is mixed with a light transmissive liquid binder, typically a silicone or epoxy, and where the mixture is applied directly to the light emitting surface of the LED die such that the LED die is encapsulated with phosphor material.

Since the phosphor material is not remote to the LED, this approach does not need phosphor materials deposited or integrally formed within the component 270. Instead, the component 270 comprises a diffuser material to diffuse the light generated by the solid-state light emitters 180.

Figure 6:
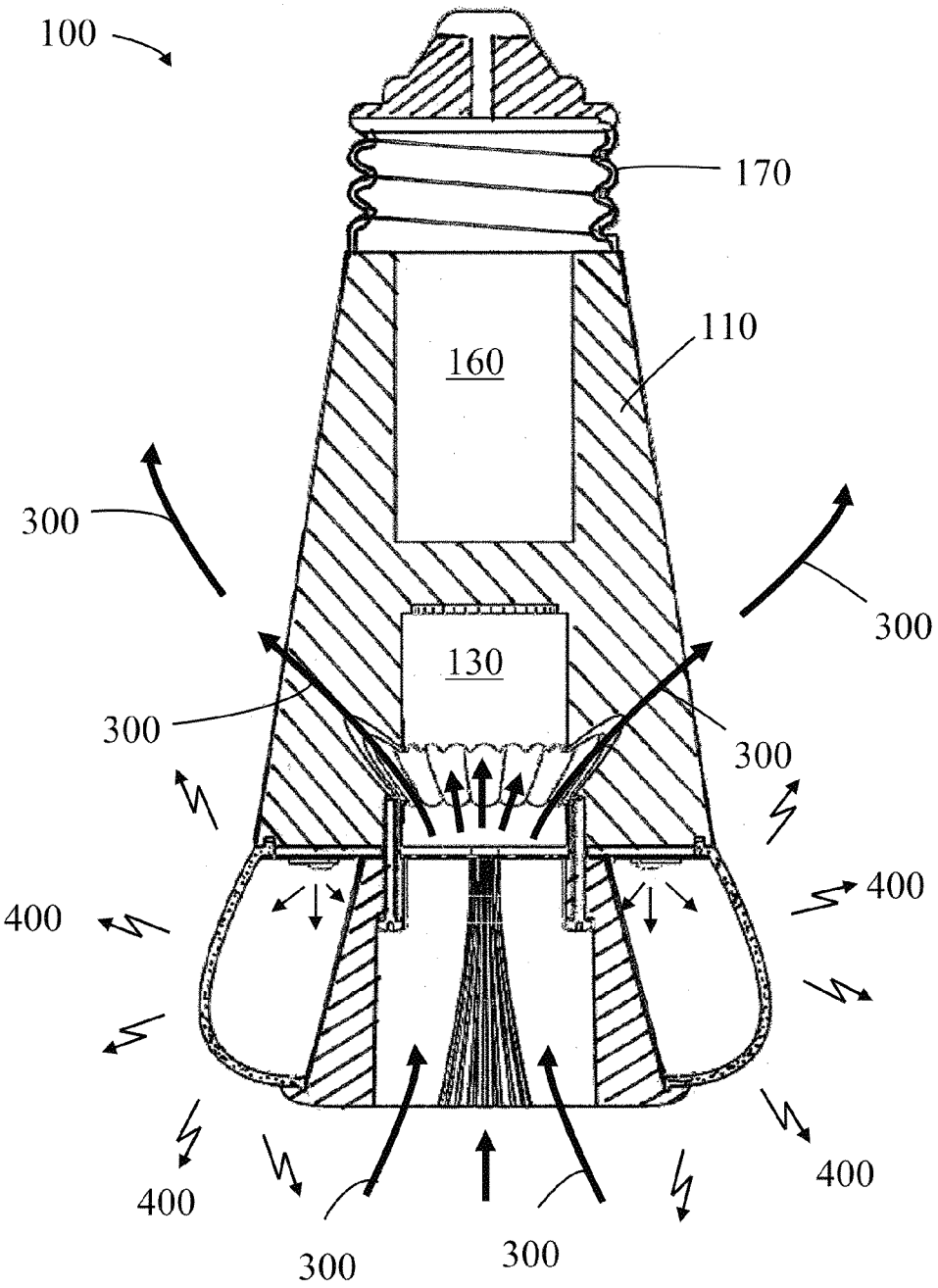
FIG. 6 is a cross sectional view of the LED-based lamp of FIG. 2 indicating air flow during operation of the lamp in a first orientation.

Operation of the lamp 100 from a thermal perspective will now be described with reference to FIG. 6 which is a cross-sectional view of the lamp in a first orientation of operation in which the connector cap is directed in a upward direction as would be the case for example when using the lamp in a pendant-type fixture suspended from a ceiling. In operation heat generated by the LEDs 180 is conducted into the base of the thermally conductive body 110 and is then conducted through the body to the exterior surfaces of the body and the interior surface of the cavity 130 where it is then radiated into the surrounding air. The radiated heat is convected by the surrounding air and the heated air rises (i.e. in a direction towards the connector cap in FIG. 6) to establish a movement (flow) of air through the device as indicated by solid arrows 300. In a steady state air is drawn into the lamp through the circular opening 260 in the duct 230 by relatively hotter air rising in the cavity 130 and duct 230, the air absorbs heat radiated by the wall of the cavity 130 and from the fins 250 and rises up through the cavity 130 and out through the passages 150. Additionally, warm air that rises over the outer surface of the body 110 and passes over the passage openings will further draw air through the lamp. Together the cavity 130, passages 150 and duct 230 operate in a similar manner to a chimney (flue) in which, by the "chimney effect", air is in drawn in for combustion by the rising of hot gases in the flue.

Configuring the walls of the passages 150 such that they extend in a generally upward direction (i.e. relative to a line that is parallel to the axis of the body) promotes a flow of air through the device by increasing the "chimney effect" and thereby increasing cooling of the lamp. It will be appreciated that in this mode of operation the circular opening 240 acts as an air inlet and the passages 150 act as exhaust ports.

The ability of the body 110 to dissipate heat, that is its heat sink performance, will depend on the body material, body geometry, and overall surface heat transfer coefficient. In general, the heat sink performance for a forced convection heat sink arrangement can be improved by (i) increasing the thermal conductivity of the heat sink material, (ii) increasing the surface area of the heat sink and (iii) increasing the overall area heat transfer coefficient, by for example, increasing air flow over the surface of the heat sink. In the lamp 100 the cavity 130 increases the surface area of the body thereby enabling more heat to be radiated from the body. For example in the embodiment described the cavity is generally cylindrical in form and can a diameter in a range 20 mm to 30 mm and a height in a range 45 mm to 80 mm, that is the cavity has a surface area in a range of about 1,000 $mm^2$ to 3,800 $mm^2$ which represents an increase in heat emitting surface area of up to about 30% for a device having dimensions generally corresponding with an incandescent light bulb (i.e. axial body length 65 to 100 mm and body diameter 60 to 80 mm). As well as increasing the heat emitting surface area, the cavity 130 also reduces a variation in the heat sink performance of each LED device. Arranging the light emitters around the opening to the cavity reduces the length of the thermal conduction path from each device to the nearest heat emitting surface of the body and promotes a more uniform cooling of the LEDs. In contrast, in an arrangement that does not include a central cavity and in which the LED devices are arranged as an array, heat generated by devices at the center of the array will have a longer thermal conduction path to a heat emitting surface than that of heat generated by devices at the edges of the array resulting in a lower heat sink performance for LEDs at the center of the array. In selecting the size of the cavity a balance between maximizing the overall heat emitting surface area of the body and not substantially decreasing the thermal mass of the body needs to be achieved.

Although the cavity increases the heat emitting surface area of the body the cavity could trap heated air and give rise to a buildup of heat within the cavity when the device is operated with the face/opening oriented in a downward direction were it not for the plurality of passages 150. The passages 150 allow the escape of heated air from the cavity and in doing so establish a flow of air in to the cavity and out of the passages thereby increasing the heat transfer coefficient of the body. It will be appreciated that the passages 150 provide a form of passive forced heat convection. Consequently the cavity and passage(s) can collectively be considered to comprise a flue. Moreover, it will be appreciated that the angle of inclination of the passages walls may affect the rate of air flow and consequently heat transfer coefficient. For example if the walls of the cavity and passages are substantially vertical the "chimney effect" is maximized since there is minimal resistance to air flow but though there will be a lower heat transfer to the moving air. Conversely, the more inclined the wall of the cavity and/or passages the greater resistance they present to air flow and the more heat is transferred to the moving air. Since in many applications it will be required to be able to operate the lamp in many orientations including those in which the axis of the body is not vertical, the passage(s) preferably extend in a direction of about 45° to a line that is parallel to the axis of the body such that a flow of air will occur regardless of the orientation of the device. The geometry, size and angle of inclination of the walls of the cavity and passages are preferably selected to optimize cooling of the body using a computation fluid dynamics (CFD) analysis. It is contemplated that by appropriate configuration of the passages 150 an increase of heat sink performance of up to 30% may be possible. Preliminary calculations indicate that the inclusion of a cavity in conjunction with the passages can give rise to an increase in heat sink performance of between 15% and 25%.

Figure 7:
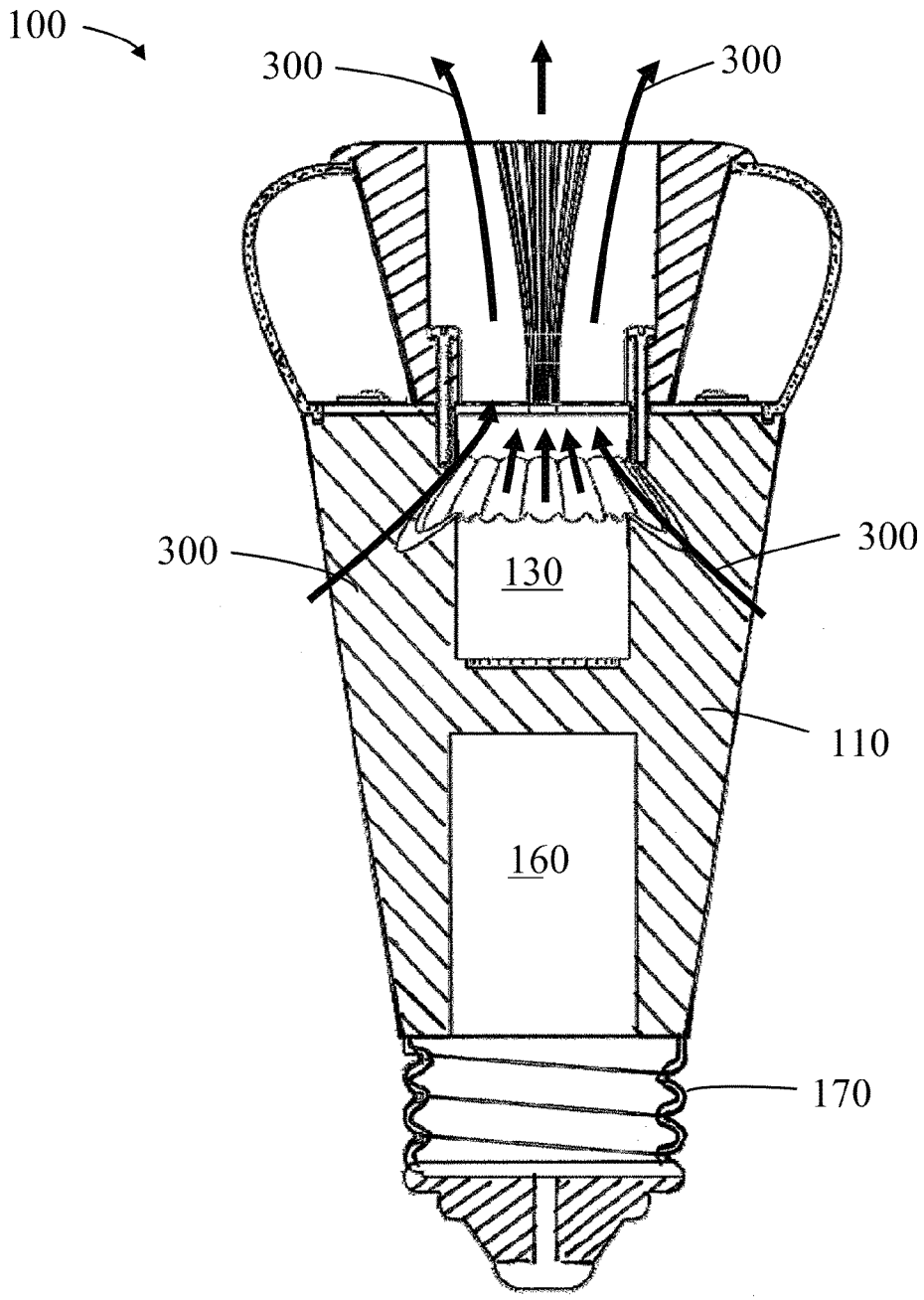
FIG. 7 is a cross sectional view of the LED-based lamp of FIG. 2 indicating air flow during operation of the lamp in a second orientation.

Referring to FIG. 7 operation of the lamp 100 is now described for a second orientation of operation in which the connector cap is directed in a downward direction as would be the case for example when using the lamp in a up-lighting fixture such as a table, desk or floor standing lamp. In operation heat generated by the LEDs 180 is conducted into the base of the thermally conductive body 110 and is then conducted through the body to the exterior surface of the body and the interior surface of the cavity 130 where it is radiated into the surrounding air. Heat that is radiated within the cavity 130 heats air within the cavity and the heated air rises (i.e. in a direction away from the connector cap in FIG. 7) to establish a flow of air through the lamp as indicated by solid arrows 300. In a steady state cooler air is drawn into the body of the lamp through the passages 150 by the relatively hotter air rising in the cavity 130, the air absorbs heat radiated by the walls of the passages and cavity and rises up through the cavity 130 and duct 230 and out of the circular opening 240. In this mode of operation the passages 150 act as air inlets and the circular cavity opening acts as an exhaust port.

The improved thermal handling abilities of the current designs permits greater LED lamp power output for the lamp 100, while still permitting the size of the heat sink equipment to be small enough such that the heat sink configuration will not unduly block emitted light from the lower portions of the lamp, e.g. the lamp 100 can provide an even distribution of light intensity within 0 degrees to 135 degrees from the vertical symmetrical axis of the lamp 100, as measured from a suitable distance from the lamp 100 (typically at least five times the aperture, maximum diameter, of the lamp, IES LM79-08). In some embodiments, the lamp is configured such that at least 5% of the total flux in lumens is emitted in the 135° to 180° zone of the lamp 100. For an A-19 lamp this typically requires a uniform emission distribution measured at a distance of at least about seven inches. This means that even higher power LED-based lamps designed according to the current embodiments can still provide proper luminous intensity distribution of the lamp sufficient to meet both form factor and performance requirements of various lamp standards.

An LED-based light lamp 100 in accordance with another embodiment of the invention is now described with reference to FIGS. 8 to 12 and is configured as an ENERGY STAR compliant replacement for a 75 W A-19 incandescent light bulb with a minimum initial light output of 1,100 lumens. The major difference between this embodiment and the previously described embodiment pertains to the configuration of the thermally conductive body 110. The body 110 is a solid body whose outer surface generally includes a plurality of latitudinal radially extending heat radiating fins 120 that is circumferentially spaced around the outer curved surface of the body 110, and which form a generally protruding curved shape. As before, the body 110 is made of a material with a high thermal conductivity (typically $\geq 150\ Wm^{-1}K^{-1}$, preferably $\geq 200\ Wm^{-1}K^{-1}$) such as for example aluminum ($\approx 250\ Wm^{-1}K^{-1}$), an alloy of aluminum, a magnesium alloy, a metal loaded plastics material such as a polymer, for example an epoxy. The body 110 can be die cast when it comprises a metal alloy or molded when it comprises a metal loaded polymer. A coaxial cylindrical cavity 130 extends into the body 110 from a circular opening 140 in the base of the body.

In contrast to the generally circular passage (conduits) 150 that connects the cavity 130 to the outer curved surface of the body in the previous embodiment, the embodiment of FIGS. 8-12 include a vertical opening (slot) 152 between the cavity 130 and the outer curved surface of the body. The vertical openings 152 are located in proximity to the base of the body, but form an elongated rectangular opening having a width that corresponds to the distance between two heat radiating fins 120. The vertical length of the vertical opening 152 corresponds to the height of the cavity 130. The vertical opening 152 are circumferentially spaced between some or all of the heat radiating fins 120.

The plurality of latitudinal radially extending heat radiating fins 120 that is circumferentially spaced around the outer curved surface of the body 110 form a generally protruding curved shape, which sweeps outward from the body at its greatest distance from the center of body 110 at the location of the vertical opening 152.

Figure 8:
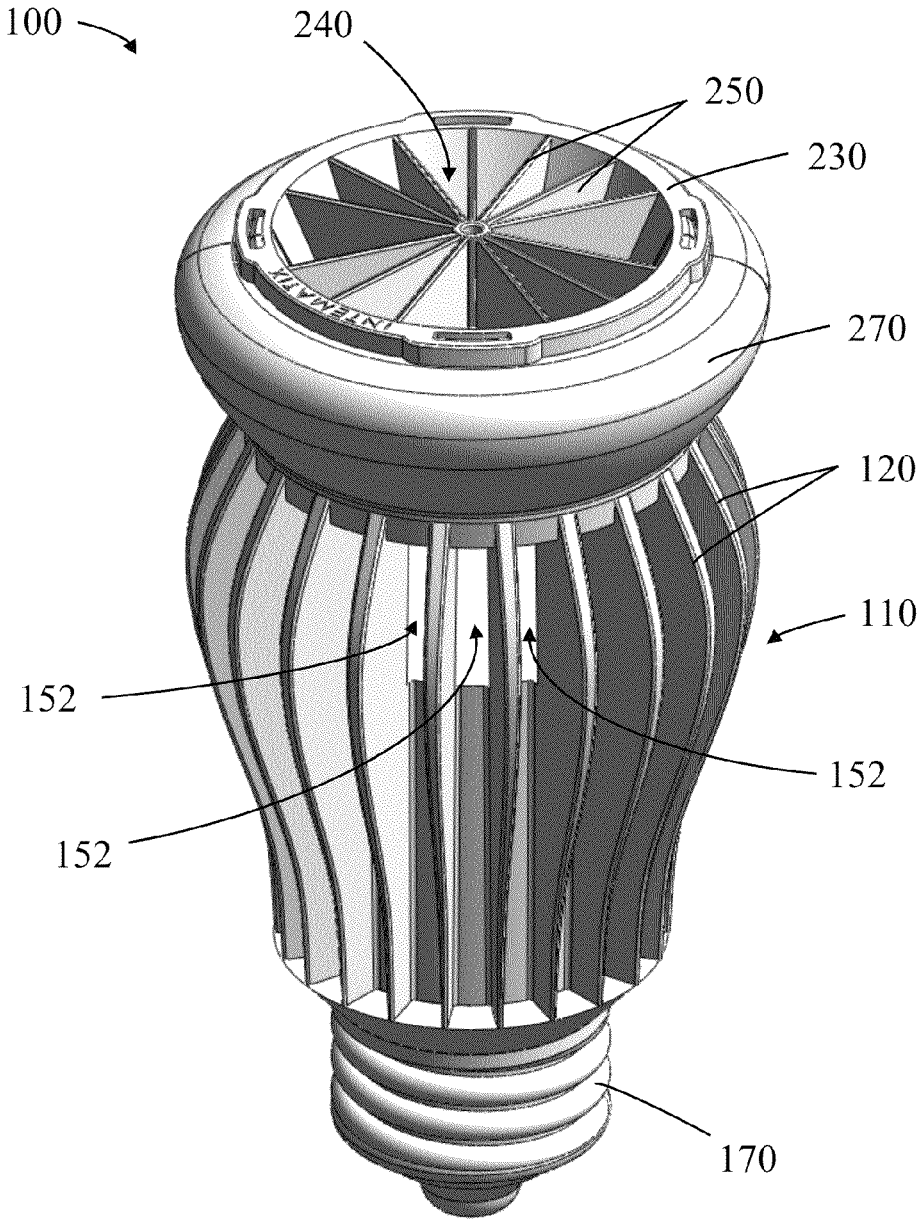
FIGS. 8-10 illustrate an alternate LED-based lamp.
Figure 9:
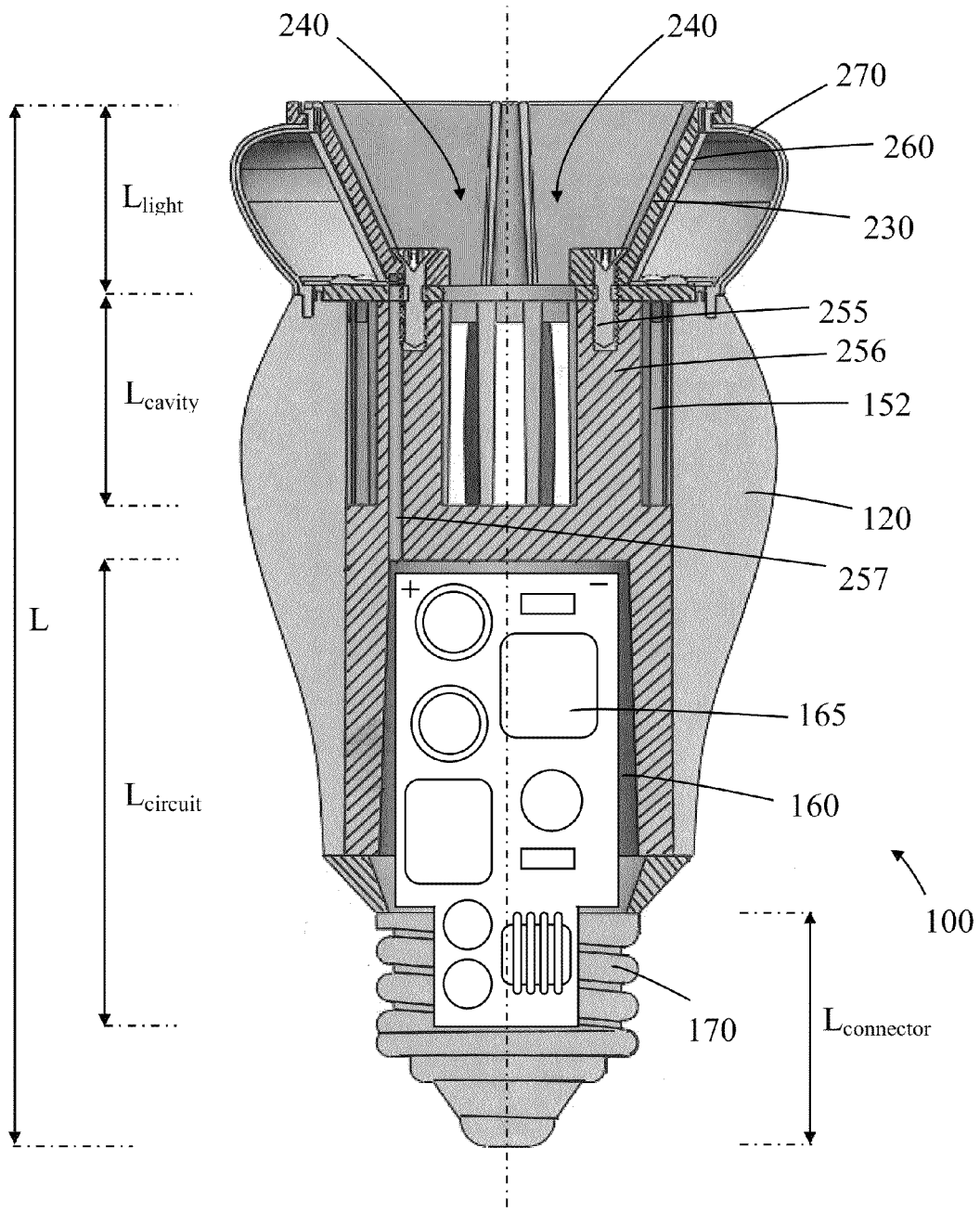
Figure 10:
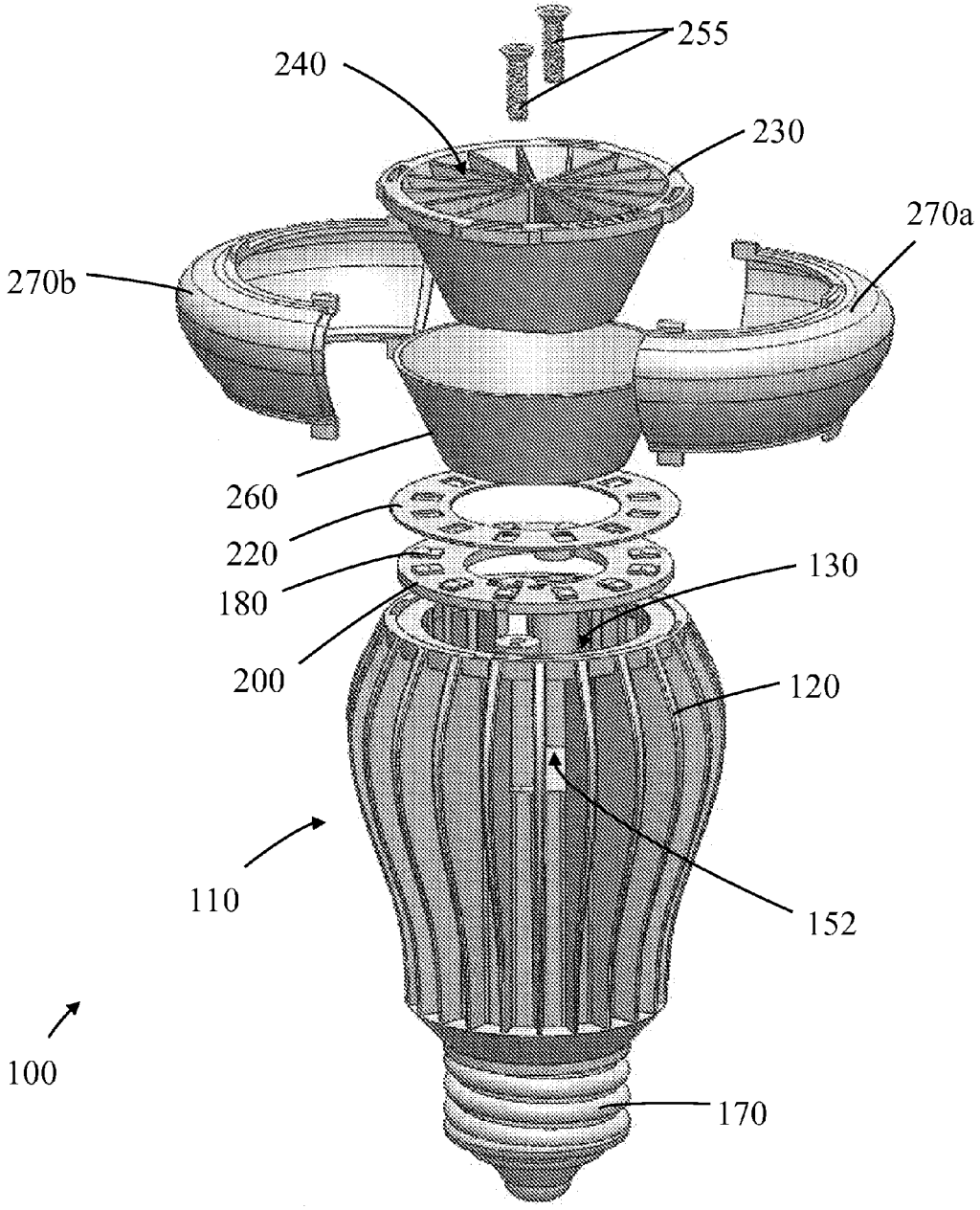
Figure 11:
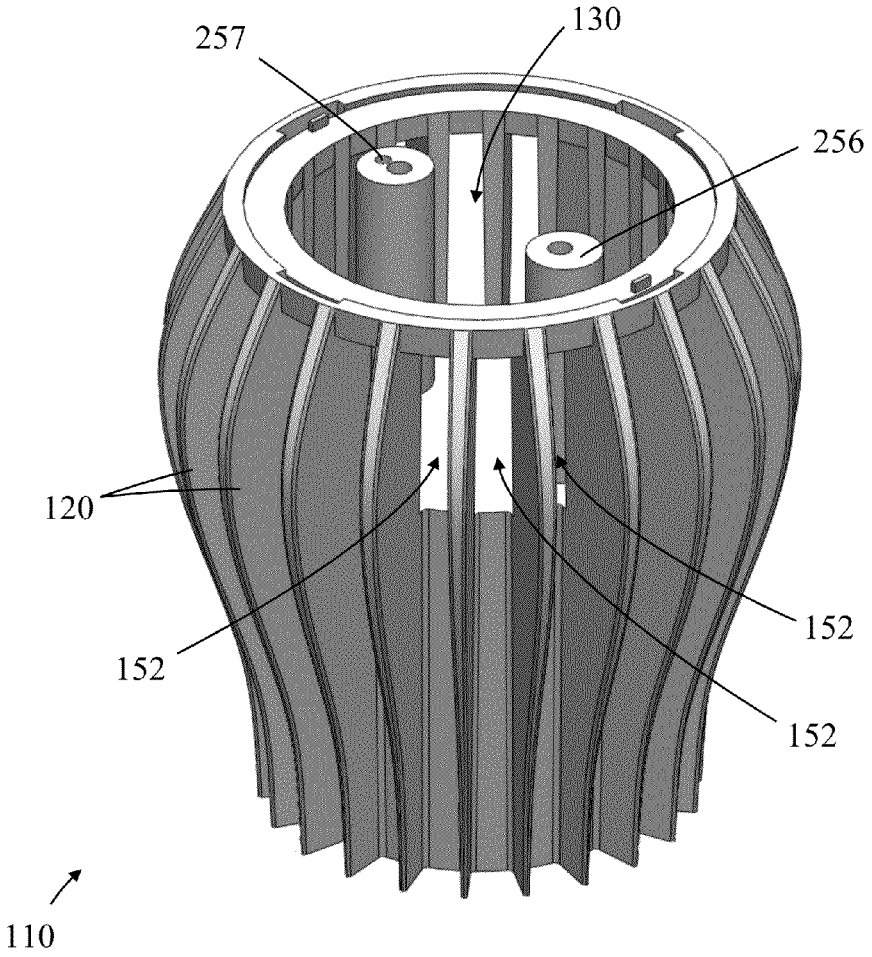
FIGS. 11-12 illustrate the body of the alternate LED-based lamp of FIGS. 8-10.
Figure 12:
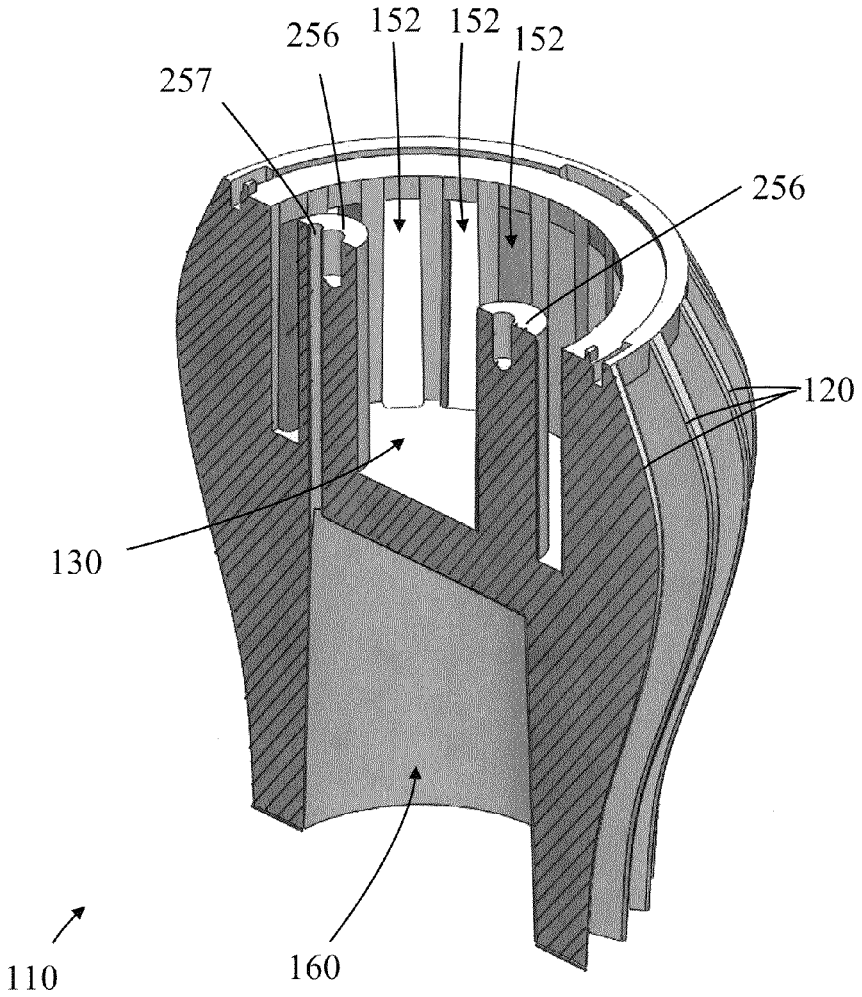

FIG. 21 is a polar diagram of the measured luminous intensity (luminous flux per unit solid angle) angular distribution for the lamp of FIGS. 8 to 10 that is a lamp with a photoluminescence wavelength conversion component that comprises a toroidal shell. Test data confirm that lamps in accordance with embodiments of the invention have an emitted luminous intensity distribution with a variation in emitted intensity of less than 18% over an emitted angles of 0° to +/−135°. Moreover lamps in accordance with embodiments of the invention emit greater than 10% of the total flux within a zone 135° to 180°.

In operation, heat generated by the LEDs 180 is conducted into the base of the thermally conductive body 110 and is then conducted through the body to the exterior surfaces of the body and the interior surface of the cavity 130 where it is then radiated into the surrounding air. The radiated heat is convected by the surrounding air and the heated air rises to establish a movement (flow) of air through the lamp. In a steady state air is drawn into the lamp by relatively hotter air rising in the cavity 130 and duct 230, the air absorbs heat radiated by the wall of the cavity 130 and from the fins 250 and rises up through the cavity 130 and out through the vertical opening 152. Additionally, warm air that rises over the outer surface of the body 110 and passes over the passage openings will further draw air through the lamp. Together the cavity 130, vertical opening 152, and duct 230 operate in a similar manner to a chimney (flue) in which, by the "chimney effect", air is in drawn in for combustion by the rising of hot gases in the flue.

Configuring the vertical opening 152 to be an elongated rectangular shape allows for very large openings to exist between the cavity 130 and the exterior of the body 110. These large openings formed by the vertical opening 152 to promotes greater airflow and air exchange through the lamp 100, such that heat collected by the duct 230, body 110 and the heat radiating fins 120 can dissipate more quickly. As previously discussed, the ability of the body 110 to dissipate heat, that is its heat sink performance, will depend on the body material, body geometry, and overall surface heat transfer coefficient. In general, the heat sink performance for a forced convection heat sink arrangement can be improved by (i) increasing the thermal conductivity of the heat sink material, (ii) increasing the surface area of the heat sink and (iii) increasing the overall area heat transfer coefficient, by for example, increasing air flow over the surface of the heat sink. In the current embodiment, the surface area of the heat sink is increased by sweeping the heat radiating fins outwards in a curved arrangement. In addition, the overall area heat transfer coefficient is increased by increasing air flow over the surface of the heat sink, e.g. by using an elongated rectangular shape for the vertical opening 152 to increase the size of the opening between the interior cavity 130 and the exterior of the body 110, which promotes increased air flow over the surface of the heat sink.

Figure 22:
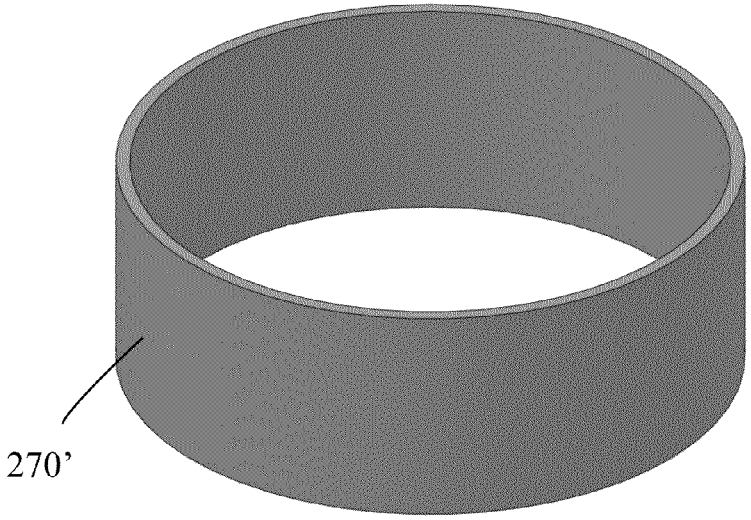
FIG. 22 illustrates an interior cylindrical wavelength conversion component.
Figure 23:
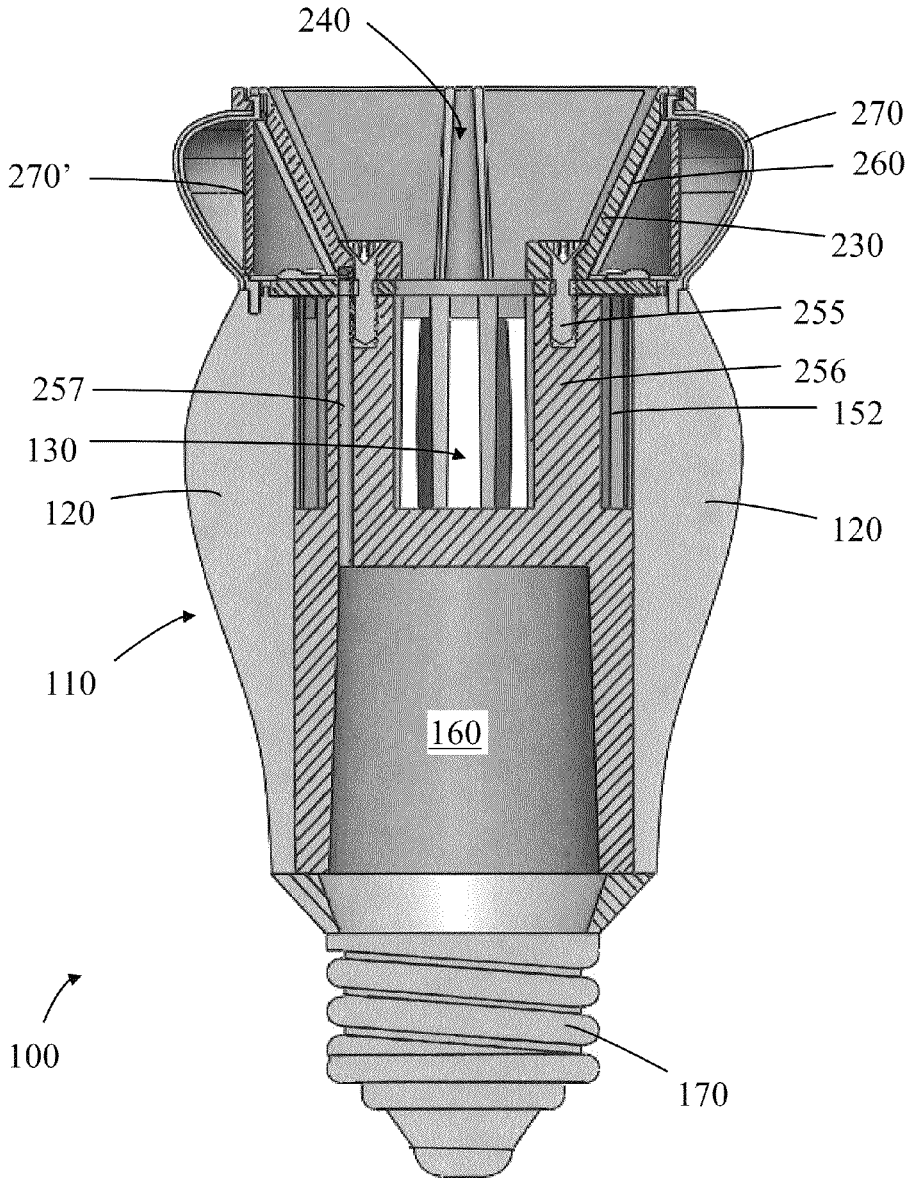
FIGS. 23-24 illustrate another LED-based lamp.
Figure 24:
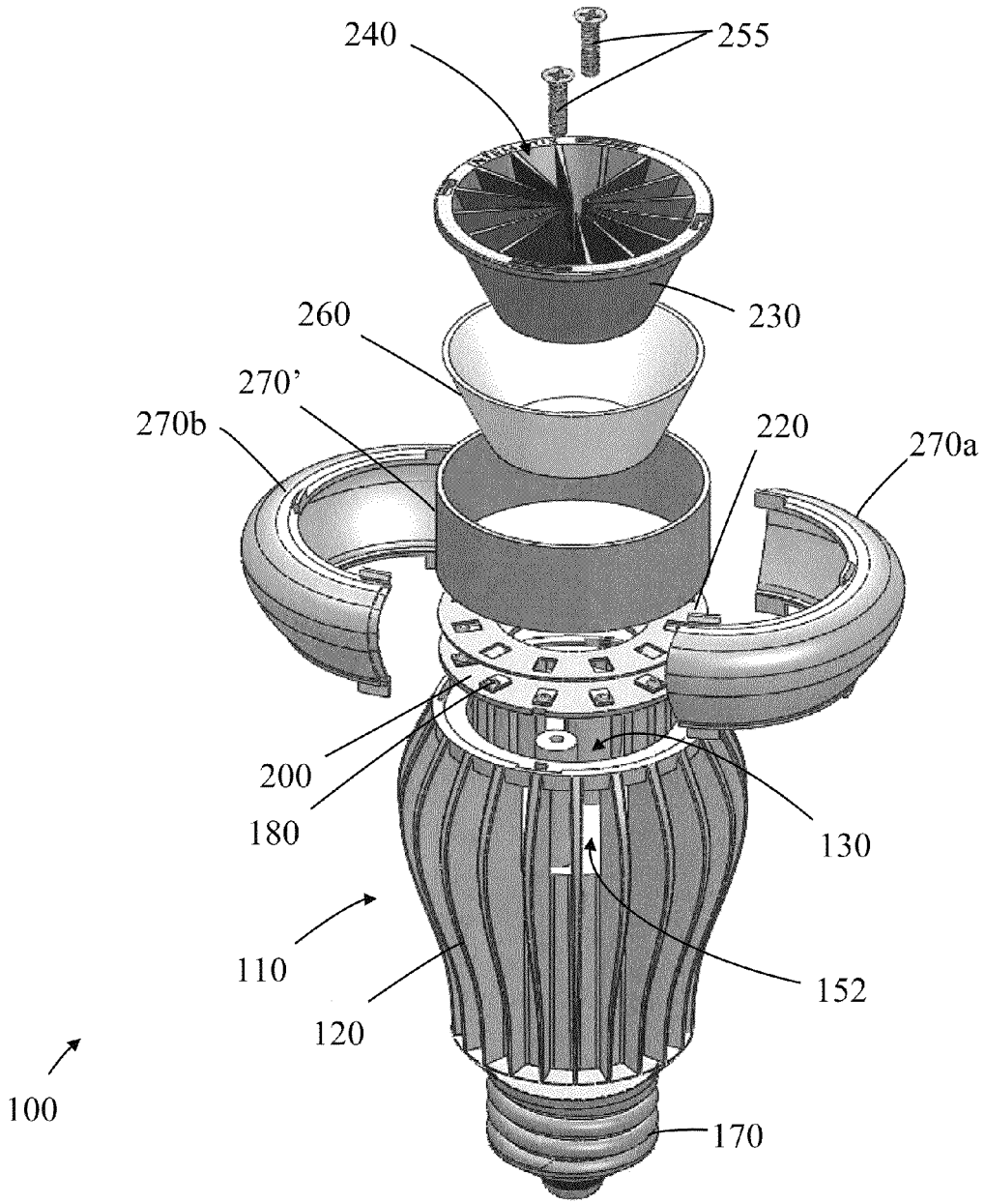

FIGS. 23 and 24 illustrate an arrangement in which the wavelength conversion component is formed as an interior component 270' that is interior to the exterior component 270. As discussed above with respect to FIG. 5, this arrangement can be employed to configure the exterior component 270 with a light diffusive material, e.g. for aesthetic considerations and to improve the visual appearance of the lamp in an "off-state". Proper selection of the material of the exterior component 270 can improve the off state white appearance of the lamp, e.g. by configuring the exterior component 270 to include a light diffusive material such as a mixture of a light transmissive binder and particles of a white colored light diffusive material such as titanium dioxide ($TiO_2$). The light diffusive material can also other materials such as barium sulfate ($BaSO_4$), magnesium oxide (MgO), silicon dioxide ($SiO_2$) or aluminum oxide ($Al_2O_3$). In this way, in an off-state, the phosphor material within the lamp will appear white in color instead of the phosphor material color which is typically yellow-green, yellow or orange in color. The interior wavelength conversion component 270' can be arranged in any suitable shape. For example, the interior wavelength conversion component 270' can have a frustonical shape, or as shown in FIG. 22, the interior wavelength conversion component 270' can be configured to have a generally cylindrical shape.

Therefore, the above embodiments allow an LED-based lamp to manage the thermal characteristics of the lamp such that the lamp complies with required dimensions and form factor specifications to fit into standard sized lighting fixtures (such as the ANSI specification for A-19 lamps), while still being able to achieve all required light performance expectations according to various lighting specifications (such as the ENERGY STAR specifications for solid-state lamps). This is illustrated in FIGS. 25*a* and 25*b*, where FIG. 25*a* shows the size requirements to comply with the A-19 lamp envelope and FIG. 25*b* shows the shape and relative size of the lamp embodiment of FIGS. 8-10. It can be seen from a comparison of these figures that the lamp embodiment of FIGS. 8-10 can easily fit within the sizing requirements of the A-19 lamp specification. While fitting within the size requirements of the A-19 lamp specification, the lamp embodiment of FIGS. 8-10 can still provide high levels of lighting performance, which is facilitated because of the advanced thermal management configuration of the current lamp embodiments as described above.

FIG. 9 also indicates the dimensions in an axial direction of various parts of the lamp 100 including: L the overall length of the lamp, $L_{light}$ the length of the light emitting proportion of the lamp, $L_{cavity}$ the length of the cavity, $L_{circuit}$ the length of the driver circuitry and $L_{connector}$ the length of the connector base. Typically $L_{connector}$ is about 25 mm for an E26 connector cap (Edison screw lamp base). Table 2 tabulates exemplary values of L, $L_{light}$, $L_{cavity}$ and $L_{circuit}$ for 75 W, 100 W and 150 W equivalent A-19 lamps. In accordance with embodiments of the invention a solid-state lamp comprises a light a light emitting portion and a base portion that houses a power supply (drive circuitry) and forms a base heat sink allowing air flow through a base heat sink duct in the base heat sink. As can be seen from Table 2 the base portion has a length that houses the drive circuitry that is between about 20% and 60% of the overall length of the lamp whereas the light emitting portion has a length that is between about 18% and 33% of the overall length. The size of the drive circuitry depends on whether the LEDs are AC or DC operable. In the case of AC operable LEDs (i.e. LEDs that are configured to be operated directed from an AC supply) the driver circuitry can be much more compact since such circuitry does not require use of components such as capacitors and/or inductors. In contrast where the LEDs are DC operable the driver circuitry (for a dimmable power supply) is currently typically about 65 mm

TABLE 2

Dimensions in an axial direction of selected parts of the lamp for different nominal power lamps

| Nominal power (W) | L (mm) | $L_{light}$ (mm) | $L_{cavity}$ (mm) | $L_{circuit}$ (mm) | $L_{light}/L$ (%) | $L_{circuit}/L$ (%) |
|---|---|---|---|---|---|---|
| 75 | ~115 | ~21 | ~23 | ~25 to ~70 | ~18 | ~20 to ~60 |
| 100 | ~115 | ~32 | ~14 | ~25 to ~70 | ~28 | ~20 to ~60 |
| 150 | ~150 | ~50 | | ~25 to ~70 | ~33 | |

Figure 26A:
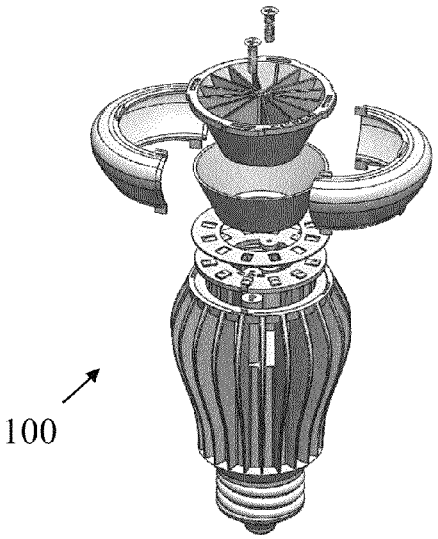
FIGS. 26*a*-26*h* illustrates assembly of the LED-based lamps of FIGS. 8-10.
Figure 26B:
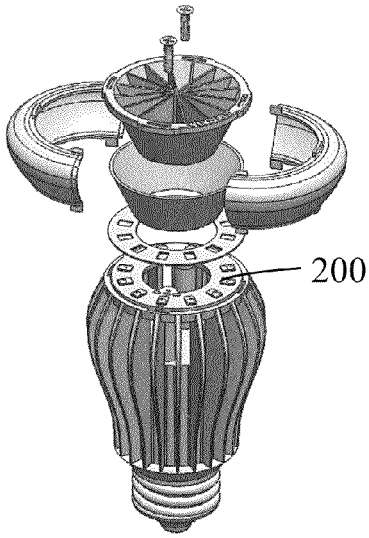
Figure 26C:
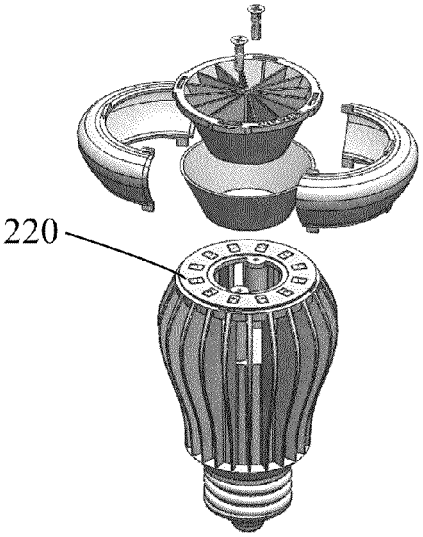

FIGS. 26*a*-26*h* illustrate an assembly sequence to assemble the lamp of FIGS. 8-10. The assembly process assumes that the drive electronics for the lamp 100 has already been installed into cavity 160 within the lamp 100, with wiring for the LEDs 180 extending from the cavity 160 to the circuit board 165 through the wiring path 257 (as shown in FIG. 9). FIG. 26*a* displays the components of the lamp 100 prior to assembly. As shown in FIG. 26*b*, the circuit board 200 is placed in its correct position at the top opening of the body 110. Next, as shown in FIG. 26*c*, the mask 220 is positioned over the circuit board 200, with the apertures 221 on the mask 200 correctly aligned with the LEDs 180 on the circuit board 200.

Figure 26D:
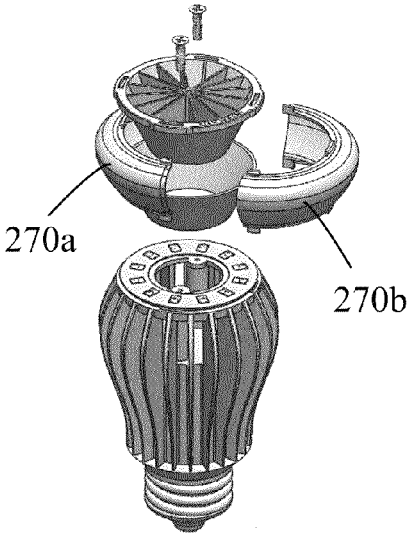
Figure 26E:
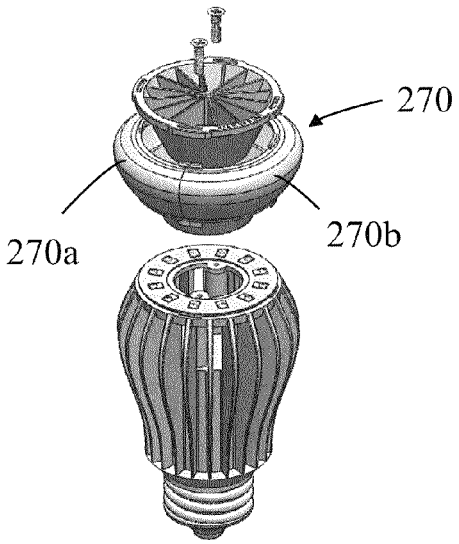
Figure 26F:
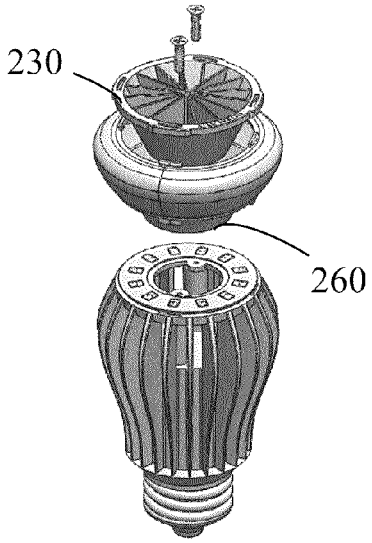
Figure 26G:
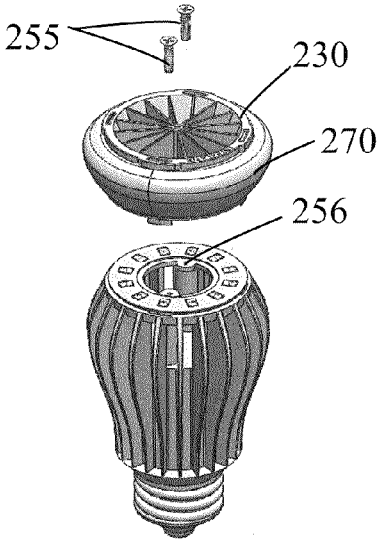
Figure 26H:
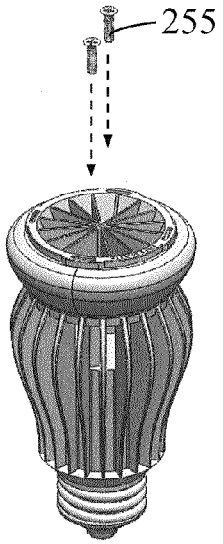
Figures 27A, 27B, 27C, 27D, 27E:
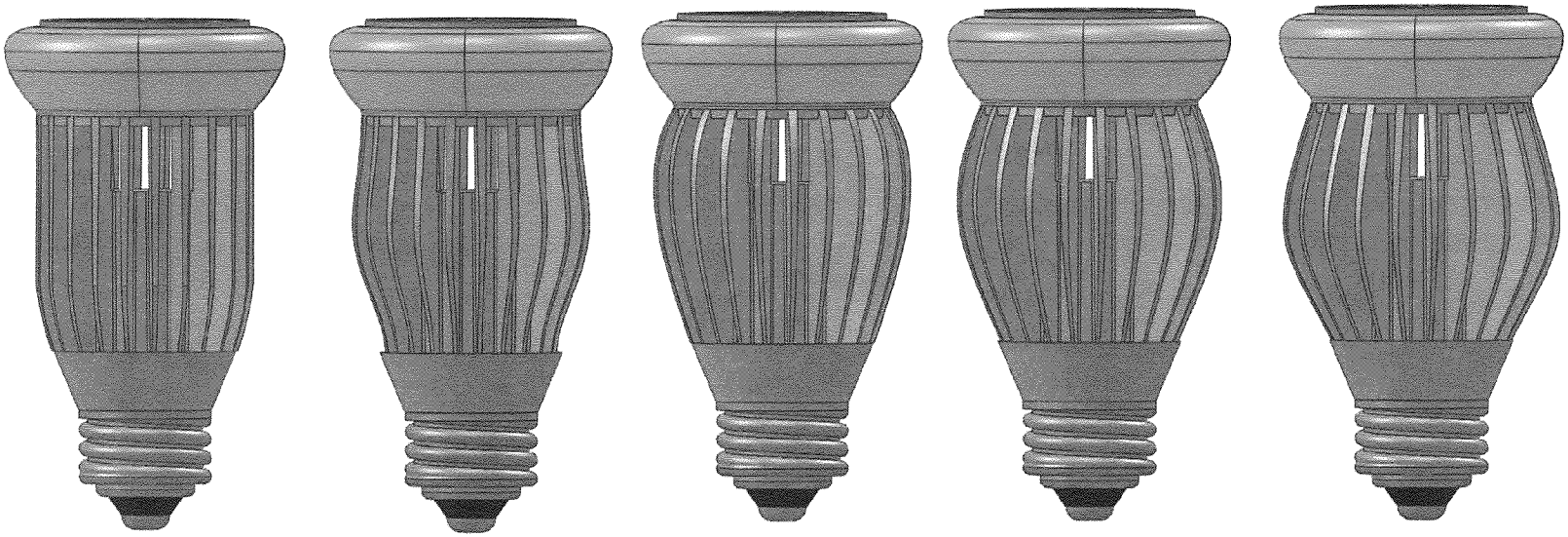
FIGS. 27*a*-27*j* are side views of LED-based lamps in accordance with embodiments of the invention.
Figures 27F, 27G, 27H, 27I, 27J:
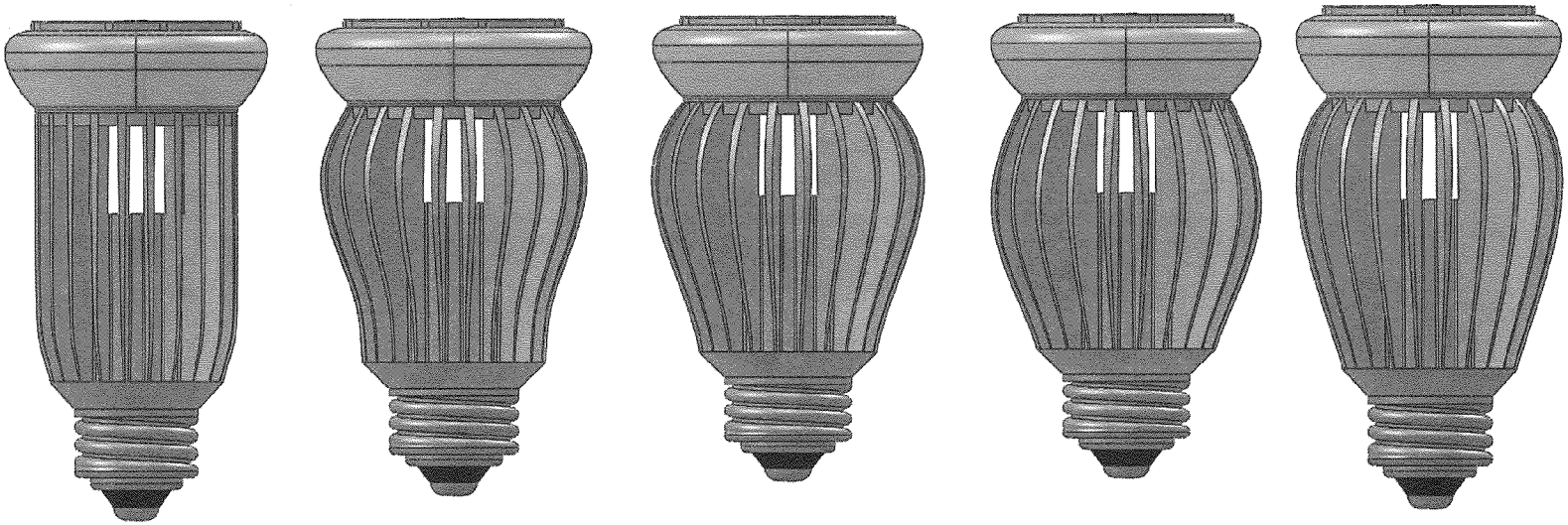
Figure 28:
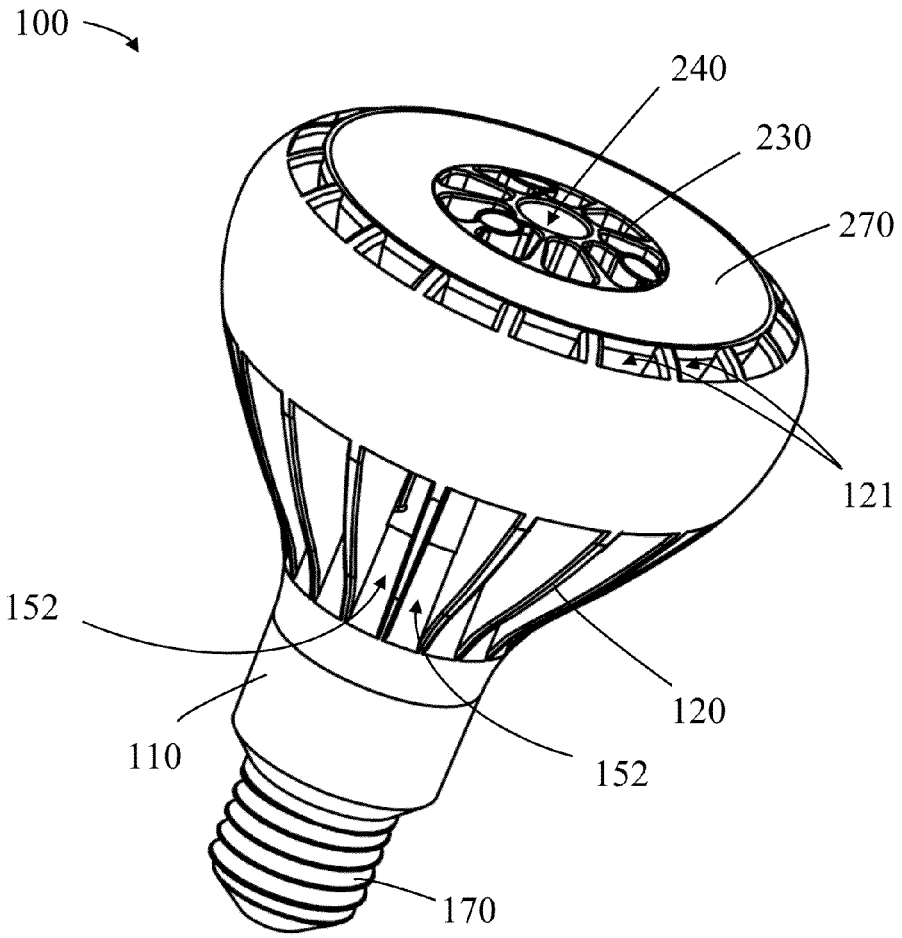
FIG. 28 is a first perspective view of an LED lamp having a wavelength conversion component at one end of the lamp.
Figure 29:
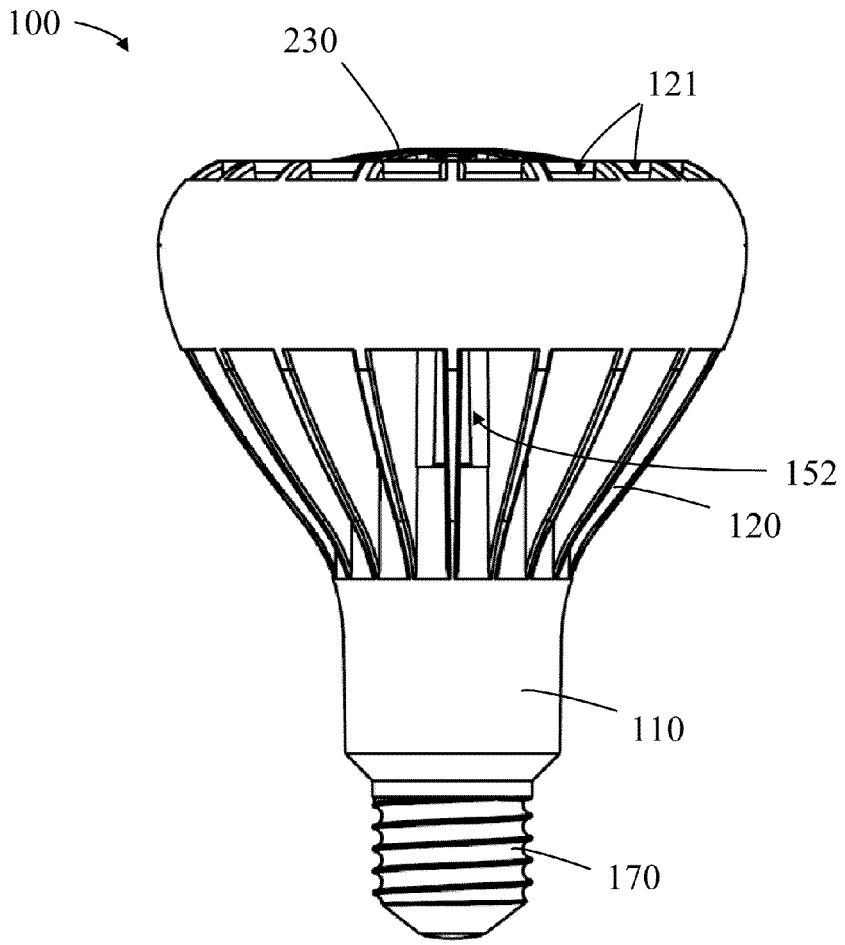
FIG. 29 is a side view of an LED lamp having a wavelength conversion component at one end of the lamp.
Figure 30:
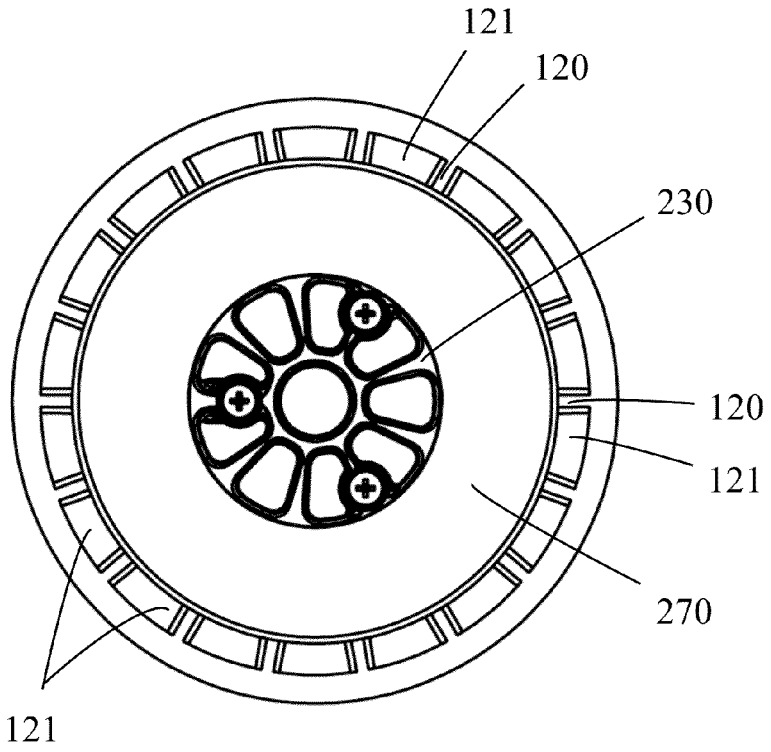
FIG. 30 is a top view of an LED lamp having a wavelength conversion component at one end of the lamp.
Figure 31:
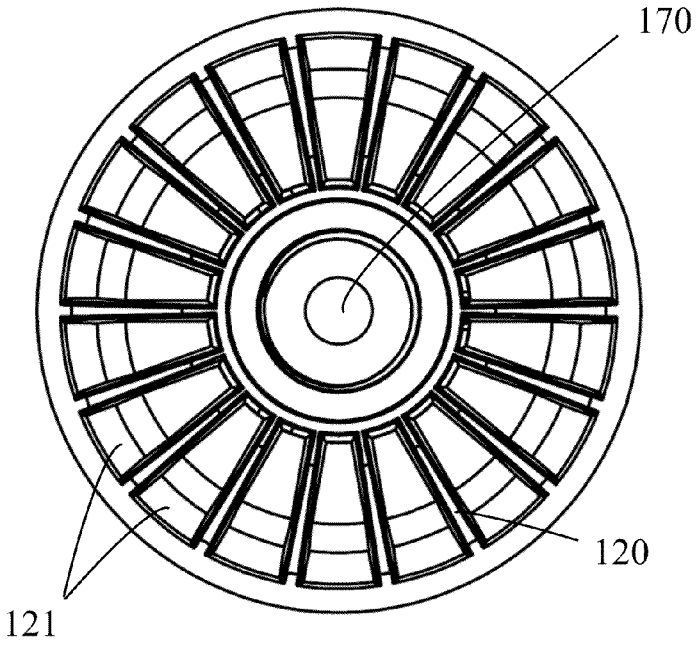
FIG. 31 is a bottom view of an LED lamp having a wavelength conversion component at one end of the lamp.
Figure 32:
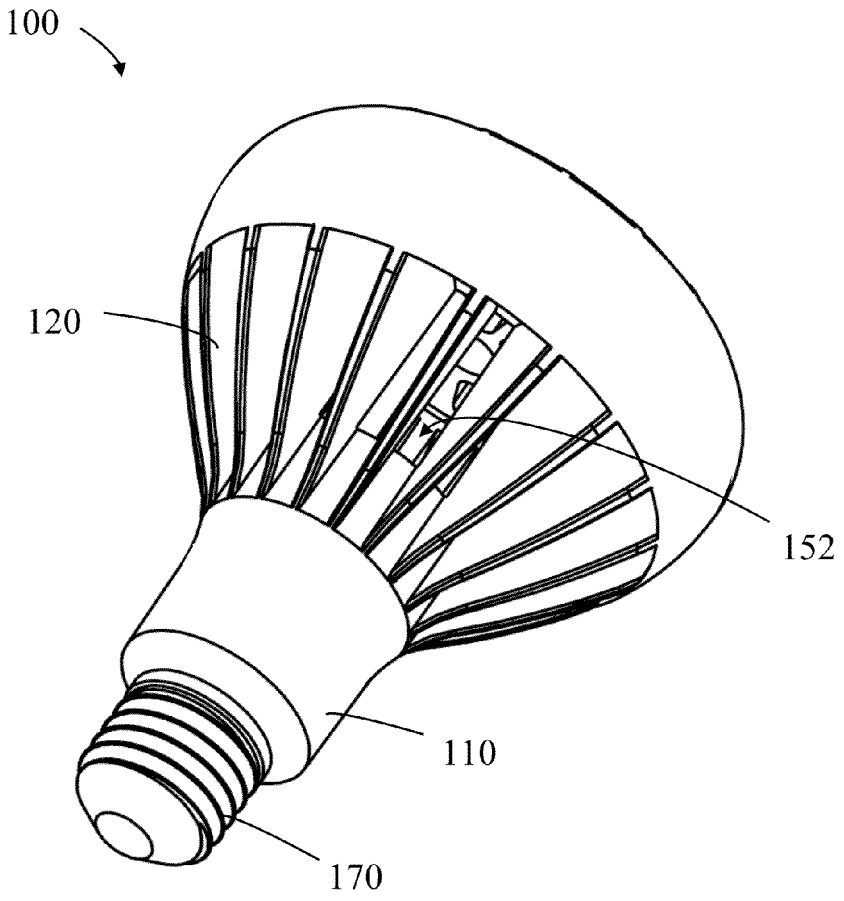
FIG. 32 is a second perspective view of an LED lamp having a wavelength conversion component at one end of the lamp.

FIGS. 26*d*-26*e* show the sequence to take the two separate parts 270*a* and 270*b* of the wavelength conversion component 270, and to assemble the two parts 270*a* and 270*b* into a continuous toroidal shape. As shown in FIGS. 26*f*-26*g*, the duct 230 is inserted into the reflective sleeve 260, and the combination of the duct 230 and the reflective sleeve 260 is inserted within the interior of the toroidal wavelength conversion component 270. As shown in FIG. 26*h*, then entire assembly of the circuit board 200, mask 220, the toroidal wavelength conversion component 270, the duct 230, the reflective sleeve 260 are then attached to the body 110 using the two screws 255 that are inserted into the screw holds 256.

This sequence illustrates the manufacturing efficiencies that can be achieved using the present embodiments. The entire lamp 100 can be assembled very securely by use of just the two screws 255. This permits the lamp 100 to be manufactured very quickly, providing savings in terms of labor costs. In addition, this assembly process and parts configuration provides a secure assembly in a very straightforward way, allowing for less chance of manufacturing errors. Moreover, this approach results in lowered material costs since only the two screws 255 are required for assembly, eliminating the cost of needing more costly devices or additional parts to secure the assembly.

FIGS. 27*a*-27*j* illustrate further examples of alternative A-19 lamp designs. The total heat emitting surface area for each design are respectively: 34.5 $inch^2$, 35.4 $inch^2$, 41 $inch^2$43 $inch^2$, 55.5 $inch^2$, 39.9 $inch^2$, 48.4 $inch^2$, 54.4 $inch^2$, 55.8 $inch^2$ and 56 $inch^2$.

FIGS. 28-36 illustrate an alternate approach to implement a solid-state lamp having a more directional emission pattern while still retaining improved thermal dissipation performance. One major difference between this embodiment and the previously described embodiment(s) pertains to the configuration of the wavelength conversion component 270. Unlike the previous embodiment where the wavelength conversion component 270 encircles the sides of the lamp 100, the present embodiment uses a wavelength conversion component 270 that is positioned at an end of the lamp 100. This configuration produces light emissions that are more directional in nature, generally directed towards the end of the lamp 100 at which the wavelength conversion component 270 is positioned. Possible uses for this type of lamp include spotlights, down lights, directional lights, or any other type of light that require greater amounts of light emitted in a particular direction.

Figure 33:
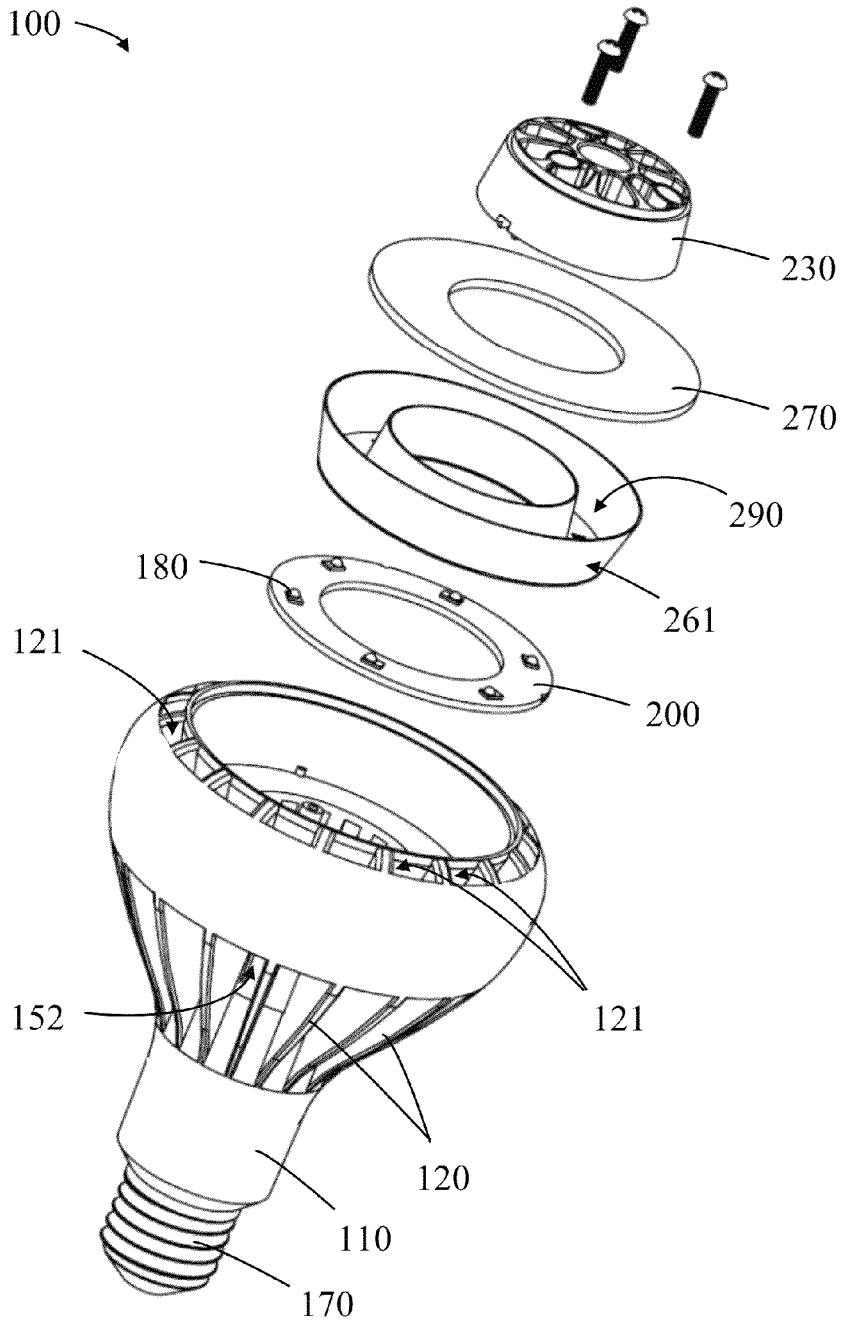
FIG. 33 is an exploded view of an LED lamp having a wavelength conversion component at one end of the lamp.

As illustrated in FIG. 33, the wavelength conversion component 270 in some embodiments comprises a generally annular shape. A central opening is formed in the wavelength conversion component 270, at which the duct 230 is mounted. The choice of the size of the wavelength conversion component 270, as well as its diameter relative to the central opening, affects the emission pattern and intensity of the light emitted by the lamp 100.

The wavelength conversion component 270 is mounted over a mixing chamber base portion 261. The mixing chamber base portion 261 comprises an annular (ring shaped) base 220, having apertures (through holes corresponding to a respective LED), an inner frusto-conical (frustum of a cone—cone with the apex truncated by a plane parallel to the base) wall 260-1 and an outer frusto-conical wall 260-2.

Figure 34:
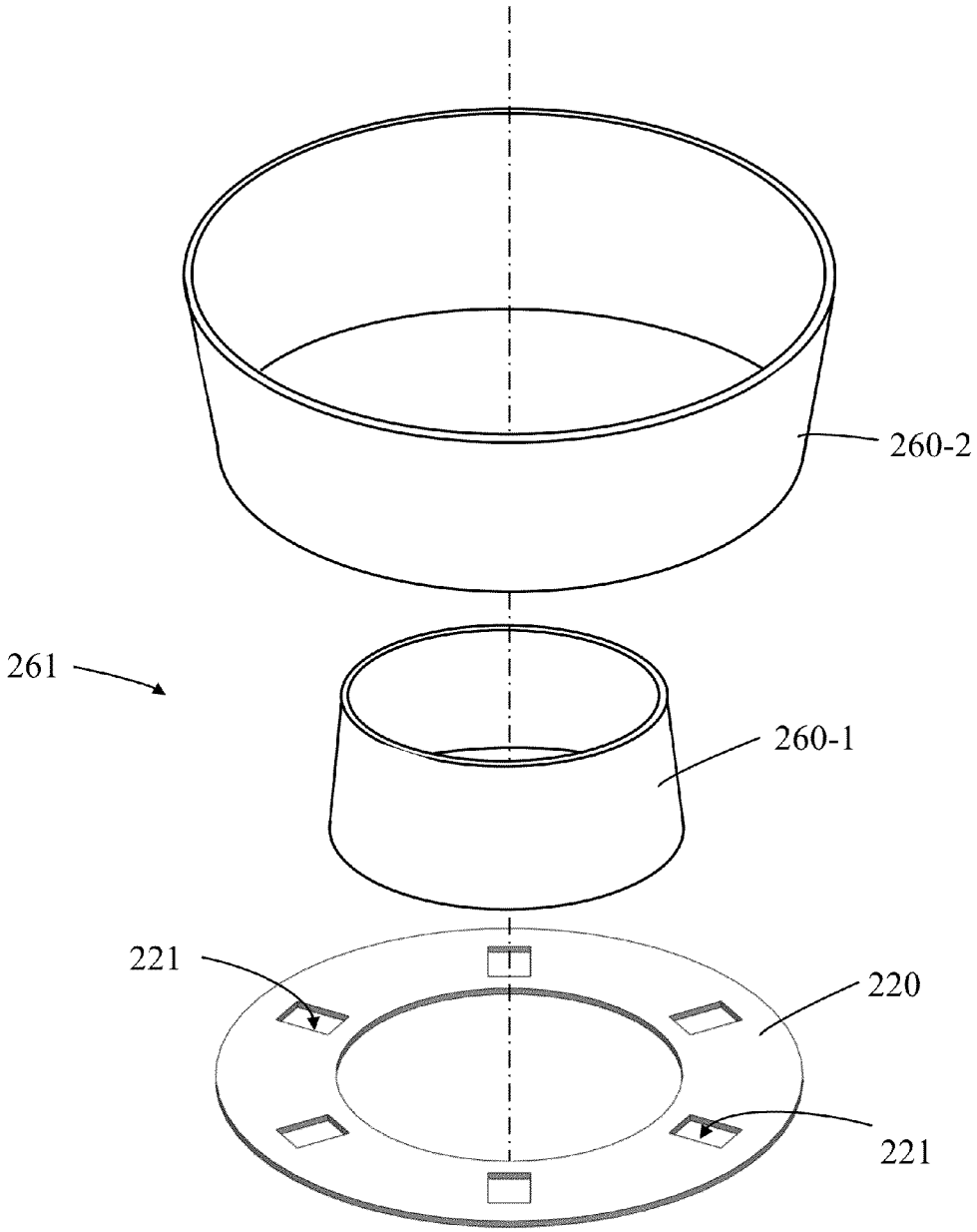
FIG. 34 is an exploded view of the components within a mixing chamber base portion.
Figure 35:
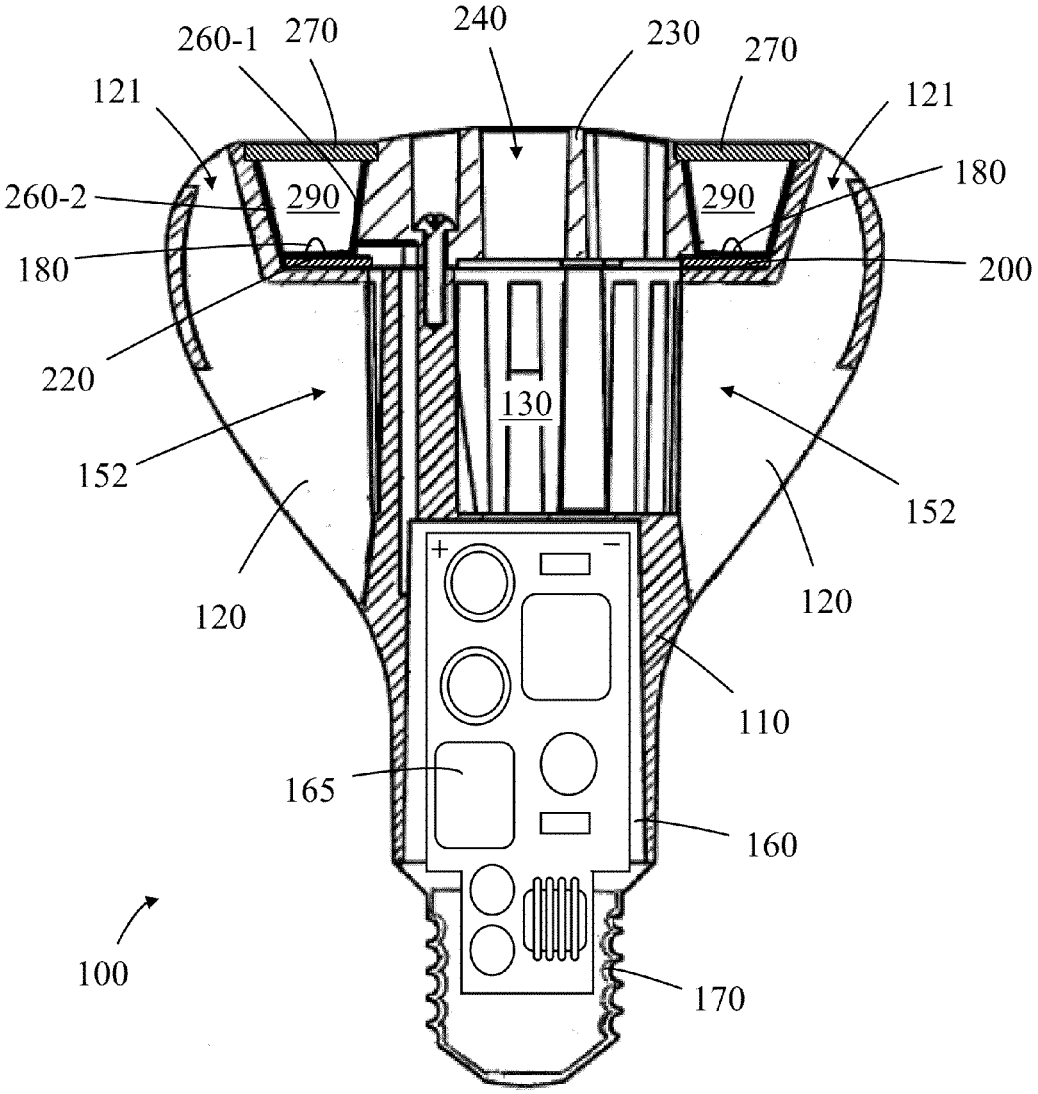
FIG. 35 is a sectional view of an LED lamp having a wavelength conversion component at one end of the lamp.

The base portion 261 can comprise separate components as indicated in FIG. 34 or comprise a unitary component as indicated in FIG. 33. The mixing chamber 290 (see FIG. 35) comprises the internal volume defined by the base portion 261 in conjunction with the wavelength conversion component 270.

The shape of the mixing chamber 290 in the exemplary embodiment is toroidal (that is defined by the rotation of a quadrilateral about an axis lying outside of the quadrilateral). In other embodiments the mixing chamber could be part of a torus (typically half) in which case the cross section is part of a circle. The exact configuration of the shape of the mixing chamber 290 is based upon the cross-sectional profile of the mixing chamber base portion 261. Other mixing chamber profiles can also be implemented by the mixing chamber base portion 261, depending upon the specific application to which the invention is directed. For example, mixing chambers having profiles with rounded bottoms, conical shapes, and/or rectilinear shapes may be implemented by the mixing chamber base 261.

The annular (ring shaped) base 220 of the mixing chamber base portion 261 includes a plurality of apertures 221 that correctly aligned with the LEDs 180 on the circuit board 200. The surface of the inner walls, inner surface of the outer walls, and base of the mixing chamber base portion 261 are reflective in nature. The surface of the inner walls, inner surface of the outer walls, and base of the mixing chamber base portion 261 can be coated with a reflective material, treated or polished to be reflective, or formed of an inherently reflective substance.

As noted above, a mixing chamber is defined by the interior profile of the mixing chamber base portion 261. Light produced by the LEDs 180 is directed to the wavelength conversion component 270 within the mixing chamber, whether directly or by reflection by the reflective walls and/or base of the mixing chamber base portion 261.

The directional lamp embodiment also includes a body configuration that provides for efficient thermal dissipation and management. The body 110 is a solid body whose outer surface generally includes a plurality of latitudinal radially extending heat radiating fins 120 that is circumferentially spaced around the outer curved surface of the body 110. As before, the body 110 is made of a material with a high thermal conductivity (typically $\geq 150\ Wm^{-1}K^{-1}$, preferably $\geq 200\ Wm^{-1}K^{-1}$) such as for example aluminum ($\approx 250\ Wm^{-1}K^{-1}$), an alloy of aluminum, a magnesium alloy, a metal loaded plastics material such as a polymer, for example an epoxy. The body 110 can be die cast when it comprises a metal alloy or molded when it comprises a metal loaded polymer. A coaxial cylindrical cavity 130 extends into the body 110 from a circular opening 140 in the base of the body.

Vertical openings 152 exist between the cavity 130 and the outer curved surface of the body. The vertical openings 152 are located in proximity to the base of the body, but form an elongated rectangular opening having a width that corresponds to the distance between two heat radiating fins 120. The vertical length of the vertical opening 152 corresponds to the height of the cavity 130. The vertical opening 152 are circumferentially spaced between some or all of the heat radiating fins 120. The plurality of latitudinal radially extending heat radiating fins 120 that is circumferentially spaced around the outer curved surface of the body 110 form a generally protruding curved shape, which sweeps outward from the body at its greatest distance from the center of body 110 at the location of the vertical opening 152.

The embodiment of FIGS. 28-36 also includes a configuration where the perimeter of the top surface of the lamp 100 includes a plurality of openings 121 that extend through passageways to the space between the heat fins 120. Each opening 121 corresponds to a rectangular shape that extends from the outer edge of the wavelength conversion component 270.

In operation, heat generated by the LEDs 180 is conducted into the base of the thermally conductive body 110 and is then conducted through the body to the exterior surfaces of the body and the interior surface of the cavity 130 where it is then radiated into the surrounding air. The radiated heat is convected by the surrounding air and the heated air rises to establish a movement (flow) of air through the lamp. In a steady state air is drawn into the lamp by relatively hotter air rising in the cavity 130, duct 230, and openings 121, and the air absorbs heat radiated by the wall of the cavity 130 and from the fins 250 and rises up through the cavity 130 and out through the vertical opening 152 and openings 121. Additionally, warm air that rises over the outer surface of the body 110 and passes over the passage openings will further draw air through the lamp. Together the cavity 130, vertical opening 152, openings 121, and duct 230 operate in a similar manner to a chimney (flue) in which, by the "chimney effect", air is in drawn in for combustion by the rising of hot gases in the flue.

Configuring the lamp to include openings 121 at the end surface as well as including the vertical opening 152 to be an elongated rectangular shape allows for very efficient thermal management properties for the lamp. The combination of the openings 121 and the vertical opening 152 promotes greater airflow and air exchange through the lamp 100, such that heat collected by the duct 230, body 110 and the heat radiating fins 120 can dissipate more quickly. As previously discussed, the ability of the body 110 to dissipate heat, that is its heat sink performance, will depend on the body material, body geometry, and overall surface heat transfer coefficient. In general, the heat sink performance for a forced convection heat sink arrangement can be improved by (i) increasing the thermal conductivity of the heat sink material, (ii) increasing the surface area of the heat sink and (iii) increasing the overall area heat transfer coefficient, by for example, increasing air flow over the surface of the heat sink. In the current embodiment, the surface area of the heat sink is increased by sweeping the heat radiating fins outwards in a curved arrangement. In addition, the overall area heat transfer coefficient is increased by increasing air flow over the surface of the heat sink, e.g. by using an elongated rectangular shape for the vertical opening 152 to increase the size of the opening between the interior cavity 130 and the exterior of the body 110, and to include openings 121, all of which promotes increased air flow over the surface of the heat sink.

Figure 36:
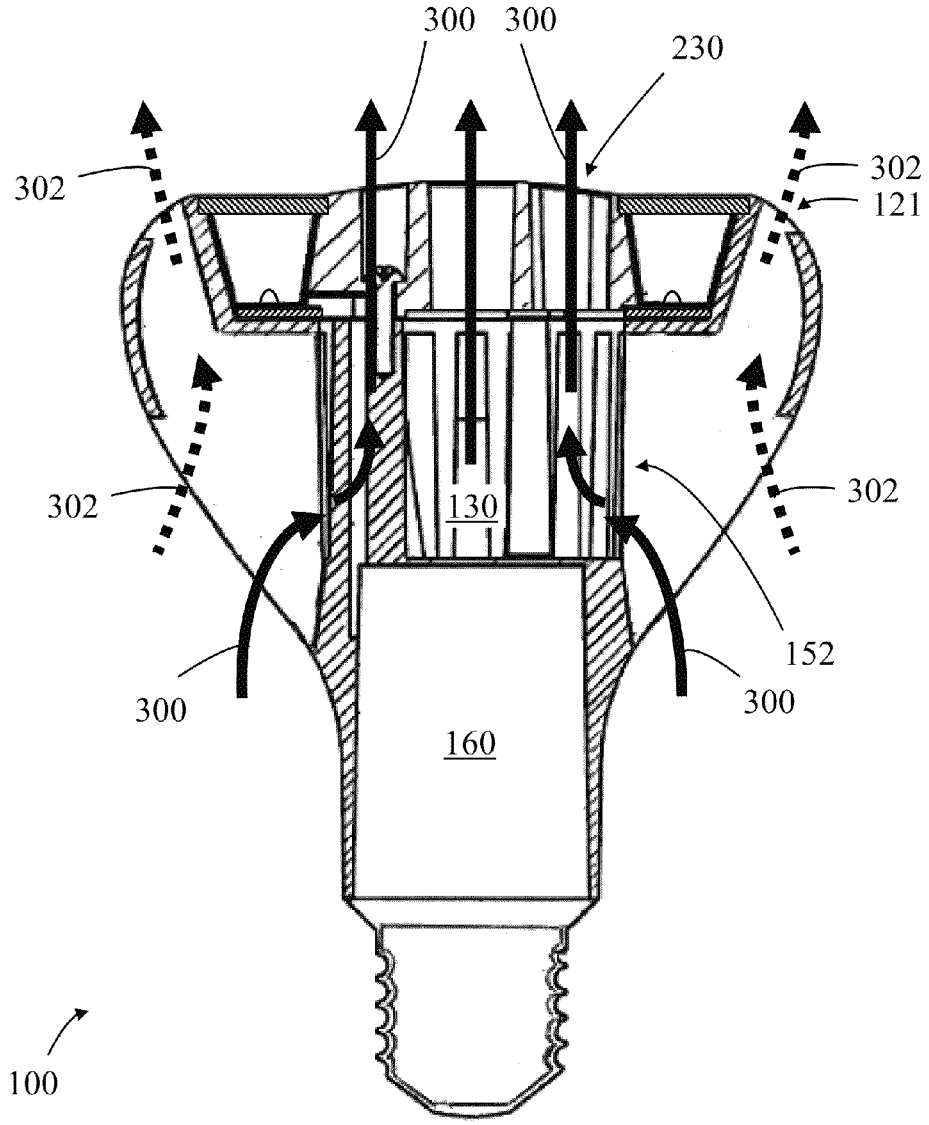
FIG. 36 is a cross sectional view of the LED-based lamp of FIG. 28 indicating air flow during operation of the lamp.

FIG. 36 illustrates operation of the lamp 100 from a thermal perspective, with the flow of air is indicated by reference numerals 300 and 302. This figure provides a cross-sectional view of the lamp in a first orientation of operation in which the connector cap is directed in a downward direction. In operation heat generated by the LEDs 180 is conducted into the base of the thermally conductive body 110 and is then conducted through the body to the exterior surfaces of the body and the interior surface of the cavity 130 where it is then radiated into the surrounding air. The radiated heat is convected by the surrounding air and the heated air rises to establish a movement (flow) of air through the device. Solid arrows 300 indicates the flow of air as steady state air is drawn into the lamp through the openings 152 by relatively hotter air rising in the cavity 130, and as the air absorbs heat radiated by the wall of the cavity 130 and from the fins 250 and rises up through the cavity 130 and out through the duct 230. Additionally, warm air that rises over the outer surface of the body 110 and passes over the passage openings will further draw air through the lamp. Dashed arrows 302 indicate the flow of air that is drawn upwards across heat fins 120 and through the outer apertures 121. Together the cavity 130, openings 152, openings 121, and duct 230 operate in a similar manner to a chimney (flue) in which, by the "chimney effect", air is in drawn in for combustion by the rising of hot gases in the flue.

Proper selection of the material of the wavelength conversion component 270 can improve the off state white appearance of the lamp, e.g. by configuring the component 270 to include a light diffusive material such as a mixture of a light transmissive binder and particles of a white colored light diffusive material such as titanium dioxide ($TiO_2$). The light diffusive material can also other materials such as barium sulfate ($BaSO_4$), magnesium oxide (MgO), silicon dioxide ($SiO_2$) or aluminum oxide ($Al_2O_3$). In this way, in an off-state, the phosphor material within the lamp will appear white in color instead of the phosphor material color which is typically yellow-green, yellow or orange in color.

It will be appreciated that embodiments of the invention are not restricted to the embodiments illustrated and described herein. For example principals embodying the invention can be applied to other omnidirectional lamp types including BT, P (Fancy round), PS (Pear shaped), S and T lamps as defined in ANSI C79.1-2002.

What is claimed is:

1. A lamp, comprising:

at least one solid-state light emitting device;

a thermally conductive body in thermal communication with the at least one solid-state light emitting device;

at least one duct comprising at least a first opening and a second opening, the at least one duct providing cooling to the thermally conductive body; and a photoluminescence wavelength conversion component remote to the at least one solid state light emitting device and mounted to one end of the lamp.

2. The lamp of claim 1, wherein the component comprises an annular shape.

3. The lamp of claim 1, wherein the component comprises an opening to receive the duct.

4. The lamp of claim 1, wherein the lamp comprises a mixing chamber base, the mixing chamber base having an inner wall, an outer wall, and a floor.

5. The lamp of claim 4, wherein a combination of the mixing chamber base and the component forms a mixing chamber.

6. The lamp of claim 4, wherein the mixing chamber base comprises reflective surfaces.

7. The lamp of claim 1, wherein the thermally conductive body further comprises a cavity and wherein the cavity and the at least one duct define a pathway for thermal airflow through the thermally conductive body.

8. The lamp of claim 7, wherein passageways extend through to openings located at the end of the lamp.

9. The lamp of claim 7, wherein the cavity comprises a plurality of openings.

10. The lamp of claim 9, wherein at least one of the plurality of openings is positioned on a side surface of the body.

11. The lamp of claim 9, and further comprising circumferentially spaced heat radiating fins on the thermally conductive body and wherein at least one of the plurality of openings are located between the heat radiating fins.

12. The lamp of claim 1, wherein the duct and the body comprise separate components.

13. The lamp of claim 1, and further comprising a light diffusive component.

14. The lamp of claim 13, wherein the light diffusive component is integrated with the component.

* * * * *